US006756175B2

(12) United States Patent
Emoto et al.

(10) Patent No.: US 6,756,175 B2
(45) Date of Patent: Jun. 29, 2004

(54) METHOD FOR FIXING TONER

(75) Inventors: Shigeru Emoto, Numazu (JP); Chiaki Tanaka, Tagata-gun (JP); Naohiro Watanabe, Sunto-gun (JP); Hiroshi Yamada, Numazu (JP); Tsunemi Sugiyama, Numazu (JP); Hiroshi Yamashita, Numazu (JP); Kazuhito Watanabe, Yokohama (JP); Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/188,753

(22) Filed: Jul. 5, 2002

(65) Prior Publication Data

US 2003/0027074 A1 Feb. 6, 2003

(30) Foreign Application Priority Data

Jul. 6, 2001 (JP) ..... 2001-206554

(51) Int. Cl.[7] ..... G03G 13/20; G03G 15/20

(52) U.S. Cl. ..... 430/124; 430/108.8; 430/109.4; 349/331

(58) Field of Search ..... 430/124, 108.8, 430/109.4, 108.4, 110.1, 137.17; 399/331

(56) References Cited

U.S. PATENT DOCUMENTS

| | | | | |
|---|---|---|---|---|
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,403,275 | B1 | 6/2002 | Kuramoto et al. | |
| 6,432,589 | B1 | 8/2002 | Uchinokura et al. | |
| 6,468,706 | B2 | 10/2002 | Matsuda et al. | |
| 6,492,079 | B2 | 12/2002 | Shimada et al. | |
| 6,519,439 | B2 * | 2/2003 | Tomita | 430/124 |

FOREIGN PATENT DOCUMENTS

| | | |
|---|---|---|
| JP | 03-039971 | 2/1991 |
| JP | 04-057062 | 2/1992 |
| JP | 04-273279 | 9/1992 |
| JP | 06-318001 | 11/1994 |
| JP | 07-219274 | 8/1995 |
| JP | 07-311479 | 11/1995 |
| JP | 07-333903 | 12/1995 |
| JP | 07-333904 | 12/1995 |
| JP | 08-050367 | 2/1996 |
| JP | 08-050368 | 2/1996 |
| JP | 08-137306 | 5/1996 |
| JP | 11-044969 | 2/1999 |

* cited by examiner

*Primary Examiner*—John Goodrow
(74) *Attorney, Agent, or Firm*—Oblon, Spivak, McClelland, Maier & Neustadt, P.C.

(57) ABSTRACT

A method of fixing toner in a belt fixing unit having a fixing roller; a heating roller; an endless fixing belt binding the heating roller and the fixing roller under tension therebetween; a pressure roller disposed to face the fixing roller intervening the fixing belt; and a fixing heater disposed inside one of the pressure roller and the heating roller, the method of fixing includes: a step for fixing a toner image on an image fixing material by conveying the toner image on the image fixing material in between a portion of the fixing belt not touching the fixing roller and the pressure roller; featured by the toner particle being spherical having a roundness of 0.96 or more and contains a colorant and resin component containing a modified polyester resin.

23 Claims, 5 Drawing Sheets

METHOD FOR FIXING TONER

BACKGROUND OF THE INVENTION

1. Field of the Invention

The present invention relates to a method for fixing toner onto a transfer material in image-forming devices such as copiers, printers and facsimile machines. More precisely, the present invention relates to a method for fixing toner onto a transfer material, using a belt-like heating medium.

2. Description of the Related Art

In monochromatic image-forming devices such as ordinary copiers, printers and facsimile machines, a latent image is formed on an image-carrying medium such as a photoconductor drum or belt in a latent image-forming unit, then the latent image is developed in a developing unit to form a toner image, and the toner image is thereafter transferred onto a transfer medium such as transfer paper represented by plain paper, special paper and the like, and fixed thereon in a fixing unit.

On the other hand, in color image-forming devices such as color copiers, color printers and color facsimile machines, in general, plural latent images are formed on an image-carrying medium such as a photoconductor drum or belt, then the latent images are developed with toners of different colors in a developing unit to form toner images of different colors, thereafter the toner images of such different colors are transferred, as combined into a full color image, onto a transfer medium such as transfer paper, and the color image on the transfer medium is then fixed thereon in a fixing unit.

With the recent trend in the art toward energy-saving and compact devices, a fixing unit utilizing a belt-like heating medium (hereinafter referred to as "belt fixing") has become widely used.

The belt fixing unit of this type makes it possible to extend the contact time of toner to the belt surface at the time of toner fixing, enabling toner fixing at a lower temperature, while toner fusion on the belt often proceeds excessively and leads to offsetting caused by melted toner adhered to the belt surface. In particular, offsetting tends to be caused with color toners since the color toners are generally required to exhibit glossiness to some extent for forming sufficiently transparent and high-quality images, and accordingly, the molecular weight distribution curve of the binder resin contained in the color toner is sharpened so that the color toner may have a sharp melting property. As a result, toner fusion at the time of image fixing proceeds, thereby causing offsetting.

In addition, additives to toner and other components may adhere to the belt-like heating medium, and the belt may be thereby worn or cracked to cause hot offsetting. Also, the belt may be thereby ruptured.

To solve the problems abovementioned, various proposals have been made for improving fixing units and toners for electrophotography.

On the other hand, oil is applied to fixing rollers in fixing units for preventing offsetting. In color image-forming devices, toners of different colors of low viscosity must be used in obtaining images with high priority in glossiness and transparency of the color, and it is indispensable to apply oil to fixing rollers to prevent offsetting.

It is known to add a releasing material (to support fixing) such as wax to toner for preventing offsetting in image fixing. However, depending on the properties of the wax used, especially when the wax added could not well disperse in toner, the wax will separate from the surfaces of toner particles or will bleed out of them in long-term use in developing units, and will stain the surfaces of carrier particles in two-component developers to thereby often worsen the charging properties of toner. In one-component developers, the wax added to toner will adhere to development rollers and to blades used for thinning toner layers, and will therefore often obstruct uniform development with toner. From the viewpoint of development, therefore, preferably an amount of wax to be added to toner is as small as possible.

Known references relating to toner and fixing units are mentioned below, and the structures in the related art disclosed therein and the problems with them are discussed.

Japanese Patent Application Laid-Open (JP-A) No. 07-219274

Configuration:

A color toner which contains a pigment-dispersed resin prepared by adding polyolefin wax and aqueous paste of pigment to a resin solution for pigment dispersion followed by heating the resulting mixture, and in which the SP value difference between the binder resin and the pigment-dispersed resin is in the range of 1.5 to 0.5.

Problem:

This is to improve the dispersibility of polyolefin wax in the binder resin in the toner. However, the polyolefin wax is not sufficiently effective for improving the offset resistance of the toner.

Japanese Patent Application Laid-Open (JP-A) No. 07-311479

Configuration:

A fixing roller for use with the toner described in Japanese Patent Application Laid-Open (JP-A) No. 07-219274, of which the surface layer is an elastic layer coated with fluororesin.

Problems:

Same as above.

Japanese Patent Application Laid-Open (JP-A) No. 07-333903

Configuration:

A toner containing a polyester resin with no THF insolubles having Mn in the range of 2500 to 3500 and Mw in the range of 50,000 to 300,000.

Problem:

This requires a large amount of fixing oil.

Japanese Patent Application Laid-Open (JP-A) No. 07-333904

Configuration:

A toner which contains wax and a polyester resin of which the amount of THF insolubles contained therein is in the range of 15 to 40% and polyhydric alcohol component is specifically defined. In the toner, a difference in refractive index between the binder resin and the wax is specifically defined.

Problem:

Difficult to form glossy images due to a large amount of THF insolubles contained in the toner.

Japanese Patent Application Laid-Open (JP-A) No. 08-50367

Configuration:

A wax-containing toner, in which the wax is an ester wax having a peak value in the molecular weight range of 350 to 850 and 900 to 4000 and having Mn of 350 to 4000 and Mw of 200 to 4000.

Problem:

Merely by defining the property of the wax contained in the toner should not achieve sufficient offset resistance of the toner.

Japanese Patent Application Laid-Open (JP-A) No. 08-50368

Configuration:

A toner which contains an ester wax in which the content of ester compounds having the same total number of carbon atoms is in the range of 50 to 95% by weight. The ester wax contains 3 to 40 parts of ester compounds with respect to 100 parts by weight of the binder resin contained in the toner.

Problem:

Merely by defining the property of the wax contained in the toner should not achieve sufficient offset resistance of the toner.

Japanese Patent Application Laid-Open (JP-A) No. 03-39971

Configuration:

A color toner which contains a resin with no toluene insolubles, in which the resin has a peak value in the molecular weight range of 500 to 2000 and 10,000 to 100,000, and has Mw of 10,000 to 80,000 and Mn of 1500 to 8000 while satisfying Mw/Mn>3.

Problem:

Sufficient offset resistance of the toner is not attained.

Japanese Patent Application Laid-Open (JP-A) No. 04-57062

Configuration:

A color toner having a flow tester melt viscosity of $105(10_5)$ poises and a softening point of 90 to 120° C., which contains a resin having Mw of 15,000 to 50,000 and Mn of 2000 to 10,000 while having Mw/Mn of 5 to 15.

Problem:

Sufficient offset resistance of the toner is not attained.

Japanese Patent Application Laid-Open (JP-A) Nos. 06-318001 and 08-137306

Problem:

In the fixing units disclosed in these publications, the toner images formed are kept exposed to preheating in the atmosphere. In low-speed image forming, the units are effective for improving the toner fixing and offset resistance, but in high-speed image forming, they are ineffective. In these units, in addition, the distance between the fixing belt B and the recording medium G must be narrowed for getting the benefit of the preheating therein. Thus, there is a need to provide countermeasure against risk of non-fixed toner images rubbing the belt.

Japanese Patent Application Laid-Open (JP-A) No. 04-273279

Problem:

The fixing device disclosed in this publication comprises a step for fixing in which a toner image is fixed onto transfer paper via a belt, followed by a step for carrying the transferred image on the belt and a step for releasing the toner image and the transfer paper from the belt. In this device, therefore, the transfer paper bearing a toner image in the step for fixing is kept preheated by the belt, and, as a result, the toner on the transfer paper tends to be excessively fused to cause offsetting. Moreover, the temperature on the image-bearing surface of the transfer paper tends to be uneven, and accordingly causes uneven image glossiness.

Japanese Patent Application Laid-Open (JP-A) No. 11-44969

Problem:

This publication proposes a toner for electrophotography, which contains a non-linear polyester binder resin and a releasing agent. When used in low-speed processors, the toner exhibits good fixing, glossiness and transparency, but in high-speed processors, the toner is still not on a satisfactory level and needs further improvement.

SUMMARY OF THE INVENTION

In reviewing the problems abovementioned, the first object of the present invention is to provide a method for fixing toner to achieve good image quality, stable in actual use in terms of toner fixing ability under low temperature, hot offsetting properties in oil-less use, glossiness of color toner, and transparency of the toner with use in OHP. The object is achieved by thorough examination of the belt fixing unit introduced in the fixing portion and by clarifying interactive properties and effective rage of the interactive properties of the toners used in the method for forming images which utilizes the fixing portion.

The second object of the present invention is to provide a method for fixing toner for forming stable and high-quality toner images on image fixing material (onto which images are fixed) which effectively prevents rubbing of non-fixed images or wrinkles on the image fixing materials, and which also allows smooth transportation and fixing of image fixing materials specifically in high speed fixing device or color image forming device.

The objects abovementioned can be attained by the aspects of the present invention described hereinafter.

The first aspect of the method for fixing toner of the present invention in a belt fixing unit having a fixing roller; a heating roller; an endless fixing belt binding the heating roller and the fixing roller under tension therebetween; a pressure roller disposed to face the fixing roller intervening the fixing belt; and a fixing heater disposed inside one of the pressure roller and the heating roller, comprises: a step for fixing a toner image on an image fixing material by conveying the toner image on the image fixing material in between a portion of the fixing belt not touching the fixing roller and the pressure roller; wherein the toner particle is spherical having a roundness of 0.96 or more and contains a colorant and resin component containing a modified polyester resin.

The second aspect of the method for fixing toner according to the first aspect further comprises, in addition to the step for fixing in the first aspect, a second step for fixing the toner image on the image fixing material by moving the portion of the fixing belt not touching the fixing roller to touch the fixing roller and conveying the toner image on the image fixing material in between the portion of the fixing belt and the pressure roller; wherein a pressure exerted in between the fixing belt and the pressure roller in the step for fixing is reduced to avoid causing wrinkles on the image fixing material.

The third aspect of the method for fixing toner according to the second aspect is characterized in that the fixing pressure in the step for fixing is 1 $kg/cm^2$ or less and the fixing pressure in the second step for fixing is not lower than the fixing pressure of the step for fixing.

The fourth aspect of the method for fixing toner according to the first aspect is characterized in that the heating roller is a heating roller of low heat capacity.

The fifth aspect of the method for fixing toner according to the first aspect is characterized in that the toner contains a releasing agent.

The sixth aspect of the method for fixing toner according to the fifth aspect is characterized in that the releasing agent is a wax having a melting point of 60 to 120° C. and the toner contains 1 to 20% by weight of the wax.

The seventh aspect of the method for fixing toner according to the sixth aspect is characterized in that the wax has a weight-average molecular weight of 400 to 5000 and an acid value of 1 to 30 mg KOH/g.

The eighth aspect of the method for fixing toner according to the fifth aspect is characterized in that the releasing agent particles are relatively uniformly dispersed inside the toner particles, and the toner particles each carrying at least 3 releasing agent particles therein account for 70% or more by number of all the toner particles.

The ninth aspect of the method for fixing toner according to the fifth aspect is characterized in that the releasing agent particles each having a dispersed particle diameter of 0.1 μm to 2 μm account for 70% or more by number of all the releasing agent particles.

The tenth aspect of the method for fixing toner according to the fifth aspect is characterized in that the releasing agent particles are needle-wise dispersed inside the toner particles, and the releasing agent particles having a maximum major diameter of 3 μm or more do not exceed 5% by number of all the releasing agent particles.

The eleventh aspect of the method for fixing toner according to the tenth aspect is characterized in that the releasing agent particles are dispersed inside the toner particles in such a controlled condition that the major diameter of each releasing agent particle is not parallel to the toner particle surface but is oriented toward the inside of the toner particle or is not exposed at the surface of the toner surface.

The twelfth aspect of the method for fixing toner according to the fifth aspect is characterized in that the releasing agent is vegetable wax having a molecular weight of 400 to 2500 and an acid value of 1 to 30 mg KOH/g.

The thirteenth aspect of the method for fixing toner according to the fifth aspect is characterized in that the releasing agent is ester wax and the needle penetration at 50° C. into the toner particles with the releasing agent dispersed therein is 3 or less.

The fourteenth aspect of the method for fixing toner according to the first aspect is characterized in that the toner is prepared by dissolving or dispersing a toner composition that contains at least a modified polyester resin and a colorant, in an organic solvent, followed by granulating the composition in an aqueous medium.

The fifteenth aspect of the method for fixing toner according to the fourteenth aspect is characterized in that the toner composition further contains a releasing agent The sixteenth aspect of the method for fixing toner according to the first aspect is characterized in that the toner is prepared by dissolving or dispersing a toner composition that contains at least a polyester prepolymer and a colorant, in an organic solvent, followed by granulating the composition in an aqueous medium while an urea bond-having polyester is formed in the resulting toner particles and while the binder resin in the toner particles being formed is subjected to polyaddition.

The seventeenth aspect of the method for fixing toner according to the sixteenth aspect is characterized in that the toner composition further contains a releasing agent.

The eighteenth aspect of the method for fixing toner according to the first aspect is characterized in that the toner further contains a non-modified polyester resin and the ratio by weight of the modified polyester resin to the non-modified polyester resin in the toner is 5/95 to 80/20.

The nineteenth aspect of the method for fixing toner according to the first aspect is characterized in that the resin component is so controlled that its tetrahydrofuran-soluble component having a molecular weight of 1000 or less accounts for 5% or less in the molecular weight distribution of tetrahydrofuran solubles in the resin component The twentieth aspect of the method for fixing toner according to the first aspect is characterized in that the resin component has a glass transition point of 55 to 70° C.

The twenty-first aspect of the method for fixing toner according to the first aspect is characterized in that the tetrahydrofuran insolubles in the resin component account for 1 to 15% of the resin component.

The twenty-second aspect of the method for fixing toner according to the first aspect is characterized in that the resin component is so controlled that a molecular weight peak of tetrahydrofuran solubles appears in the range of 1000 to 30,000 in the molecular weight distribution of tetrahydrofuran solubles in the resin component and the tetrahydrofuran soluble component having a molecular weight of 30,000 or mope account for 1% or more in the soluble molecular weight distribution, and the toner has a weight-average particle diameter of 3 to 10 μm.

The twenty-third aspect of the method for fixing toner according to the first aspect is characterized in that the molecular weight distribution of tetrahydrofuran solubles in the resin component is arranged to have the number-average molecular weight of the solubles ranging from 2000 to 15,000 and the ratio of weight-average molecular weight/number-average molecular weight to be 10.0 or less.

The first aspect of the present invention provides a method for fixing toner rapidly and stably under high-speed processing or color image-forming.

The second aspect of the present invention provides a method for fixing toner according to the first aspect, which allows forming of good images, satisfying toner fixing, and hot-offset resistance in high-speed processors.

The third aspect of the present invention provides a method for fixing toner according to the second aspect, which allows smooth transportation of the image fixing material without causing wrinkles, and improving toner fixing in low-temperatures.

The fourth aspect of the present invention provides a method for fixing toner according to the first aspect, which shortens rise time and saves energy, while maintaining toner fixing at low temperatures.

The fifth aspect of the present invention provides a method for fixing toner according to the first aspect, in which the toner contains a releasing agent.

The sixth aspect of the present invention provides a method for fixing toner according to the fifth aspect, used in oil-less belt-fixing devices.

The seventh aspect of the present invention provides a method for fixing toner according to the sixth aspect, which exhibits releasability in a wide range of oil-less fixing.

The eighth aspect of the present invention provides a method for fixing toner according to the fifth aspect, which improves toner releasability and glossiness.

The ninth aspect of the present invention provides a method for fixing toner according to the fifth aspect, which improves transparency of a color toner.

The tenth aspect of the present invention provides a method for fixing toner according to the fifth aspect, which improves toner fixing and glossiness.

The eleventh aspect of the present invention provides a method for fixing toner according to the tenth aspect, which improves toner flowability and charge stability.

The twelfth aspect of the present invention provides a method for fixing toner according to the fifth aspect, which improves toner fixing ability.

The thirteenth aspect of the present invention provides a method for fixing toner according to the fifth aspect, which improves fixing ability of a dry toner.

The fourteenth aspect of the present invention provides a method for fixing toner according to the first aspect, which improves fixing ability, glossiness and transparency of the toner.

The fifteenth aspect of the present invention provides a method for fixing toner according to the fourteenth aspect, which improves toner releasability and glossiness.

The sixteenth aspect of the present invention provides a method for fixing toner according to the first aspect, which improves fixing ability, glossiness and transparency of a color toner.

The eighteenth aspect of the present invention provides a method for fixing toner according to the first aspect, which improves fixing and charge stability of the toner.

The nineteenth aspect of the present invention provides a method for fixing toner according to the first aspect, in which the dry toner has satisfying heat resistance.

The twentieth aspect of the present invention provides a method for fixing toner according to the first aspect, which improves fixing ability of the toner.

The twenty-first aspect of the present invention provides a method for fixing toner according to the first aspect, which improves releasability of the toner.

The twenty-second aspect of the present invention provides a method for fixing toner according to the first aspect, which improves releasability of the toner.

The twenty-third aspect of the present invention provides a method for fixing toner according to the first aspect, which improves toner glossiness.

In addition, when the binder component in the toner is controlled to contain THF-soluble content having a molecular weight of 1000 or less accounts for 5% or less in the molecular weight distribution of THF solubles in the binder component, or when the polyester resin in the toner has a glass transition point of 55 to 75° C. and has an acid value of 1 to 30 mg KOH/g, or when the THF-insoluble content of the binder component in the toner is 1 to 15%, the toner may be stably fixed to produce good images. In particular, the color toner forms glossy and transparent images suitable for use in OHP.

Further, when the binder component in the toner is controlled to have a molecular weight peak of THF solubles appears in the range of 1000 to 30,000 in the molecular weight distribution of THF solubles in the binder component and the THF-soluble content having molecular weight of 30,000 or more account for 1% or more in the soluble molecular weight distribution and the toner has a weight-average particle diameter of 3 to 10 $\mu$m, or when the molecular weight distribution of THF solubles in the binder component in the toner is arranged to have number-average molecular weight of the solubles 2000 to 15,000 and the ratio of weight-average molecular weight/number-average molecular weight at 10.0 or less, then a dry toner which covers a wide range of image fixing is obtained.

Moreover, in the present invention, since the proportion of wax existing on the surfaces of the toner particles can be reduced and, in addition, wax is finely dispersed, the toner forms good color images of high transparency. For these reasons, the toner of the present invention allows designing of compact and inexpensive color copiers and printers without a need to provide oils.

Furthermore, the toner forming method of the present invention realized dispersion of a fine releasing agent inside the toner particles which was unattained by conventional premix grinding methods. In toner particles prepared through suspension polymerization, wax is enclosed in the resin. Therefore, as compared with ground toner, an effect of releasability of the toner prepared by the suspension polymerization with respect to contained amount of wax deteriorates. Still another advantage of the toner of the present invention is that it can readily disperse even in a polyester resin, which, however, could not be used as a binder resin in ordinary polymerization to form toner. In addition, the profile of the toner of the present invention is easy to control, and showing favorable properties of the powdered toner. The present invention has made it possible to form a toner having high transfer efficiency.

According to the toner forming method of the present invention, wax can be finely dispersed in the toner formed, as compared with ground toner. In an ordinary method of grinding toner, fine toner particles having a particle diameter of 4 to 6 $\mu$m are substantially difficult to produce in view of the productivity and the production costs. Despite of the situation, the present invention has made it possible to easily produce such fine toner particles. The unit size of wax particles to be dispersed inside the toner particles in the present invention can be reduced, and therefore, the toner particles can form color images of higher quality, especially those of higher transparency suitable for use in OHP. Combining the toner and the belt-fixing device in the present invention solves the problems mentioned below which was not solved in conventional oil-less belt-fixing devices.

1) As compared with roller fixing, the surface pressure in belt fixing is difficult to increase, and the releasing agent is hardly released from the toner in oil-less devices. Therefore, in high-speed oil-less fixing, the releasability only covers a narrow range.

2) Since the surface pressure in belt fixing is low, the color images formed has less glossiness.

3) Since the nip width is broad in belt fixing, often causes wrinkles.

DESCRIPTION OF THE PREFERRED EMBODIMENTS

Figure 1:
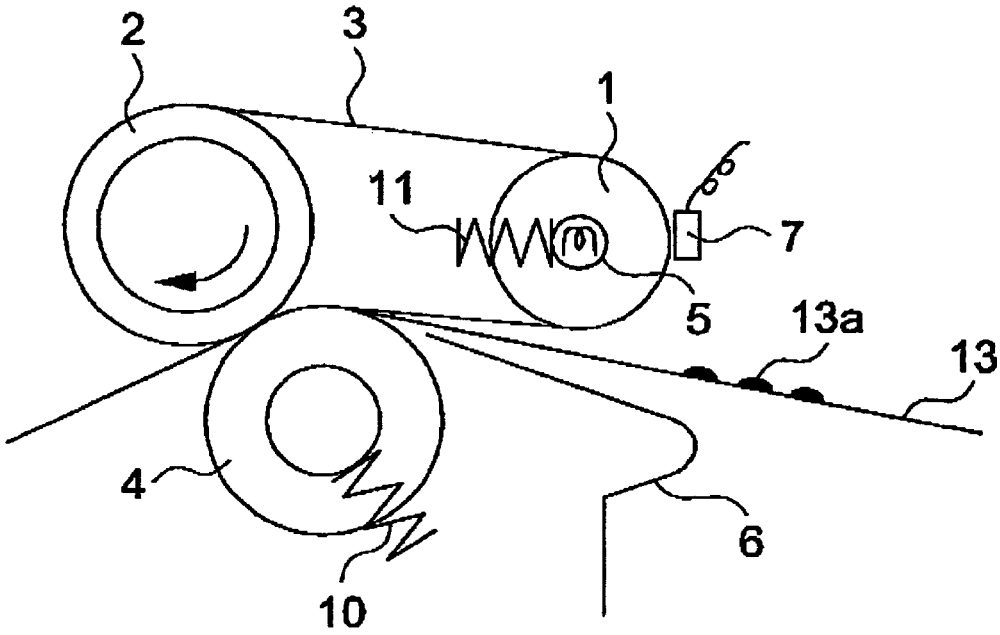
FIG. 1 is a conceptual view showing a belt fixing unit for use in the method for fixing toner of the present invention.
Figure 2:
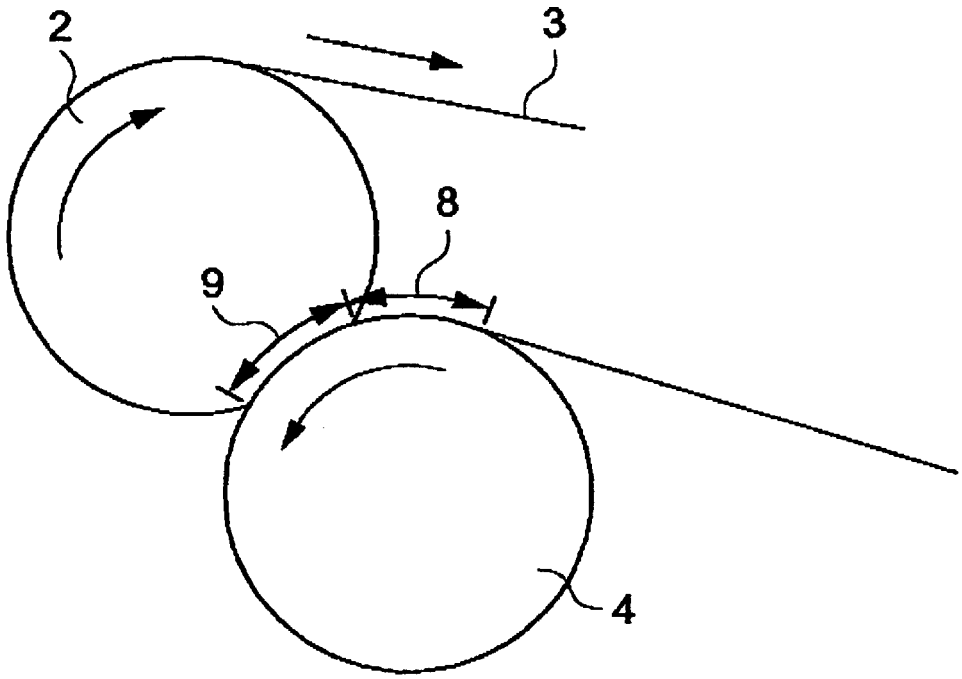
FIG. 2 is a partly exploded view of the belt fixing unit shown in FIG. 1.

Belt Fixing Unit for use in the Method for Fixing Toner of the Present Invention FIG. 1 shows one example of a belt fixing unit for use in the method for fixing toner of the present invention; and FIG. 2 is a partly exploded view of FIG. 1. The belt fixing unit illustrated is for oil-less toner fixing in a color image-forming device, and it is specifically designed to prevent hot-offsetting and shortened rise time.

In FIG. 1 and FIG. 2, 1 indicates a heating roller, 2 indicates a fixing roller, 3 indicates an endless fixing belt, 4 indicates a pressure roller, 5 indicates a heater for heating the fixing belt, 6 indicates an inlet guide plate, 7 indicates a temperature monitoring means, 8 indicates a part of the fixing belt for first fixing, 9 indicates a part of the fixing belt for second fixing, 10 indicates a pressure unit with a pressure spring, 11 indicates a tension applicator with a tension spring, and 13 indicates transfer paper with unfixed toner 13*a* thereon.

The fixing belt 3 is laid along the heating roller 1 and the fixing roller 2 under tension therebetween (to which a predetermined tension is applied), and the pressure roller 4 is disposed adjacent to the fixing roller 2 via the fixing belt 3. The pressure roller 4 is pressed against the fixing roller 2 via the fixing belt 3 in the part 9 for second fixing; but in the part 8 for first fixing, it is pressed against the fixing belt 3, not kept in contact with the fixing roller 2.

The heating roller 1 with the heater 5 built therein is made of a thin-wall metal pipe (e.g., aluminum iron, copper or stainless steel pipe) having a small diameter and having a lowered heat capacity, and it facilitates rapid rising of the device. The fixing belt 3 is heated by the heater 5 via the heating roller 1, and the temperature monitoring means 7 monitors the surface temperature of the fixing belt 3 heated by the heating roller 1. Based on the temperature signal from the temperature monitoring means 7, a temperature controller (not shown) controls the heater 5 so that the surface of the fixing belt 3 can be kept at a predetermined temperature.

Driven by motors (not shown), the fixing roller 2, the heating roller 1, the pressure roller 4 and the fixing belt 3 are rotated. Transfer paper, a type of transfer material is conveyed to run through the fixing belt 3 and the pressure roller 4, and the toner image on the transfer paper is heated by the fixing belt 3 and fixed onto it. In the part 8 for first fixing, the fixing pressure (the pressure between the fixing belt 3 and the pressure roller 4) is controlled low so as not to wrinkle the transfer paper in the step for fixing; and in the part 9 for second fixing, the fixing pressure (the contact pressure between the fixing belt 3 and the pressure roller 4) is controlled to attain the intended fixing in the second step for fixing.

The heating roller 1 is disposed movable, and this is pressed by the pressure spring 10 to give a tension to the fixing belt 3; and the pressure roller 4 is pressed by the pressure spring 10, and it presses the fixing roller 2 via the fixing belt 3. The fixing pressure in the step for fixing is controlled by the tension of the fixing belt 3 that is controlled by the tension spring 11, while the fixing pressure in the second step for fixing is controlled by the pressure spring 10. If desired, the pressure spring 10 may be fitted to the fixing roller 2 to press it, whereby the pressure roller 4 is pressed against the fixing roller 2 via the fixing belt 3.

In this device illustrated, the heater 5 heats the fixing belt 3 via the heating roller 1 of low heat capacity, and the device can rise in a moment. In addition, in the device, the distance for fixing is kept long sufficiently for the step for fixing and the second step for fixing (that is, the nip width is long, and therefore the nip time is very long, ranging from 50 ms to 200 ms), and the fixing belt 3 is self-coolable (that is, the fixing belt 3 does not have a heat source around its surface with an unfixed toner image thereon in the parts 8 and 9 for fixing, and therefore the surface of the fixing belt 3 in those parts is spontaneously cooled after toner fixing thereon). Accordingly, the device ensures a good temperature range favorable for fixing, and covers wide range of image fixing.

Moreover, since the fixing pressure in the step for fixing in which the transfer paper first reaches the pressure roller 4 is kept satisfactorily low, for example, it is 0.5 kg/cm$^2$ or less, preferably 0.2 kg/cm$^2$or less, the transfer paper can smoothly enter the nip area for fixing between the fixing belt 3 and the pressure roller 4, and therefore, the frequency of wrinkles of the transfer paper can be reduced to be not higher than that in conventional devices (that is, the frequency of wrinkles of the transfer paper is not higher than that in hot roller fixing devices).

The fixing device to be used in carrying out the method for fixing toner of the present invention is a belt fixing device as illustrated herein, of which the basic configuration comprises the fixing roller 2, the heating roller 1, the endless fixing belt 3 of low heat capacity laid along the heating roller 1 and the fixing roller 2 under tension therebetween, and the pressure roller 4 disposed adjacent to the fixing roller 2 via the fixing belt 3.

The heating roller 1 has the heater 5 installed inside it for heating the fixing belt. For reducing its heat capacity, the heating roller 1 is preferably made from a material of low specific heat and high heat conductivity, for which, for example, preferred is metal such as aluminum, copper, iron or stainless steel.

The fixing belt 3 is heated by the heater 5 via the heating roller 1. For improving the thermal responsibility of the fixing belt and for ensuring the flexibility thereof, it is desirable that the thickness of the belt base is 30 to 150 $\mu$m, for which, for example, preferred is nickel or polyimide. Also for improving the thermal responsibility of the fixing belt, the release layer of the fixing belt 3 may be made of silicone rubber preferably having a thickness of 50 to 300 $\mu$m, or fluororesin preferably having a thickness of 10 to 50 $\mu$m.

The temperature monitoring means 7 is to monitor the surface temperature of the fixing belt 3 heated by the heating roller 1. Based on the temperature signal from the thermistor 7, a temperature controller (not shown) controls the heater 5 so that the surface of the fixing belt 3 can be kept at a predetermined temperature.

Driven by motors (not shown), the fixing roller 2, the heating roller 1, the fixing belt 3 and the pressure roller 4 are rotated. Transfer paper, a type of transfer material is conveyed in the direction of the illustrated arrow to run through the nip area for fixing between the fixing belt 3 and the pressure roller 4, and the toner image on the transfer paper is heated by the fixing belt 3 and fixed onto it.

Because of the configuration of the device, the heating roller does not require any specific large load. The force necessary for laying the fixing belt 3 along the two rollers under tension therebetween may be 1 kgf (9.8 N)/one roller, under which the fixing belt 3 functions satisfactorily. Since the heating roller 1 for heating the fixing belt is spaced from the nip area for fixing, the heating roller 1 does not require fixing pressure and therefore does not receive any large load. Accordingly, the heating roller 1 can be down-sized and thin-walled, and its heat capacity can be reduced. This shortens the rise time of the device.

The heat capacity of the heating roller 1 of low heat capacity is preferably 45 cal/° C. or less, more preferably 15 cal/° C. or less.

Comparison Between Belt Fixing Device and Hot Roller Fixing Device

The belt fixing device to be used in the method for fixing toner of the present invention is compared with a hot roller fixing device. Both in the belt fixing device and in the hot roller heating device, the lowermost temperature for toner fixing lowers to the same degree with the increase in the nip time, and the belt fixing is preferred to the hot roller fixing since the contact time of the fixing belt with the toner surface can be prolonged in the former. In the hot roller fixing device, the nip width of the fixing roller can be broadened.

In this respect, the belt fixing device will be inferior to the hot roller fixing device because of the belt conveyor mechanism of the former in which the nip width is difficult to broaden. Therefore, when the belt fixing device is driven in an oil-less condition, the nip pressure is often insufficient for releasing the releasing agent from the toner to prevent offset, and as a result, the offset temperature will be often low.

Especially in high-speed oil-less processors, the requirements of both high-speed fixing and hot-offset resistance must be satisfied, and the fixing unit for such high-speed oil-less processors must be economical to save energy. Given that situation, it is desired to further improve the properties of toner than before in order to obtain an advanced toner that is well usable in any oil-less processors and has the advantages of good releasability and broad latitude in fixing. We, the present inventors have found a novel toner suitable to the method for fixing toner of the present invention, and the novel toner is described hereinafter.

Toner of the Present Invention

The toner suitable for the method for fixing toner of the present invention is a dry toner comprising a resin and a colorant, and the resin contains a modified polyester resin. Preferably, in the toner, the content of the polyester resin including a modified polyester resin is the highest of all the resin component therein.

The toner may be prepared by dissolving or dispersing a toner composition in an organic solvent followed by granulating the composition in an aqueous medium while the binder resin in the toner particles being formed is subjected to polyaddition; or by dissolving or dispersing a toner composition that contains a prepolymer, in an organic solvent, followed by granulating the composition in an aqueous medium while an urea bond-having polyester is formed in the resulting toner particles and while the binder resin in the toner particles being formed is subjected to polyaddition. Thus prepared, the toner satisfies the requirements of good fixing and hot-offset resistance. When the toner is used in oil-less belt fixing devices, a releasing agent is added thereto. If desired, the toner may also contain a charge-controlling agent that will be mentioned hereinunder. The amount of the charge-controlling agent may be 0.1 to 5%, by which the charge level of the toner can be controlled.

In many cases, wax is used for the releasing agent, which, however, is not limited thereto. The releasing agent to be in the toner may be any and every material of releasing ability. The oil-less fixing device for use herein is not limited to a completely oil-less one but oil may be infiltrated into the rollers. In this case, even a small amount of wax will be effective.

Of various dry toners, especially full-color toners are required to have the basic characteristics of thermal storability, low-temperature fixing ability and hot-offset resistance and additional characteristics of color reproducibility, transparency and glossiness that are contradictory to the basic characteristics. To realize all these characteristics, the matters indispensable to full-color toners are that the colorant and wax must well disperse in them (for good color reproducibility and transparency) and the resin in the toners must have a sharp molecular weight distribution (for good transparency and glossiness), and, in addition, the toners must further satisfy the requirements of low-temperature fixing and hot-offset resistance. In this respect, since the toner of the present invention can be prepared through granulation in water, polyester can be used in preparing the toner particles. Therefore, the granulation method is favorable for preparing the toner of the present invention that has well-balanced fixing ability and offset resistance.

The toner of the present invention may contain a polyester having a polar group with an urea bond, and the pigment therein readily adsorbs the polyester at its urea bond moiety. Therefore, the toner of the type is characterized by its ability to well disperse the pigment therein. On the other hand, the urea bond moiety in the polyester serves for negative adsorption against wax in the toner, therefore repelling wax in the interface between the polyester and wax. Another effect of the polyester in the toner is that it stably disperses wax of low polarity in the toner. In addition, the major part of the resin in the toner is a low molecular component having a molecular weight of 30,000 or less, and the resin in the toner is controlled to have a sharp molecular weight distribution. Accordingly, the toner of the present invention satisfies not only good glossiness and transparency but also low-temperature fixing ability.

For hot-offset resistance of toner, various studies have heretofore been made to control the molecular weight distribution of the binder resin in toner. For example, for satisfying the two contradictory requirements of low-temperature fixing ability and hot-offset resistance of toner, a binder resin having a broad molecular weight distribution is added to toner; or a resin mixture of a high-molecular component having a molecular weight of from hundreds of thousands to millions and a low-molecular component having a molecular weight of from thousands to tens of thousands, therefore having two molecular weight peaks or more in its molecular weight distribution is added to toner so that the two resin components thus in the toner may individually exhibit their own functions in the toner. Of the resin mixture, the high-molecular component is more effective against hot offsetting when it has a crosslinked structure or it is gelled.

However, since full-color toner is required to form glossy or transparent images, adding a large amount of such a high-molecular resin component thereto is unfavorable. In the toner of the present invention, the molecular weight of the polyester can be enlarged through chain extension at the urea bond. Therefore, the toner of the present invention attains good hot-offset resistance while satisfying the requirements of transparency and glossiness.

In the present invention, a toner composition is granulated in an aqueous medium, and the binder resin in the toner particles being formed is subjected to polycondensation. Here, a method of GPC measurement will be described. The column is stabilized in a heat chamber at 40° C. and into the column under this temperature, THF (tetrahydrofuran) as solvent is led to flow in at a flow rate of 1 ml/min, and sample THF solution of the resin adjusted to sample concentration of 0.05 to 0.6% by weight is injected in the amount of 50 to 200 $\mu$l, and measured. The molecular weight of the sample is calculated from the relationship between the logarithmic value of the calibration curve of a standard sample, monodispersed polystyrene and the retention time of the sample in the columns. The calibration curve is prepared, using a polystyrene standard sample. The standard sample, monodispersed polystyrene is, for example, a commercial product from Tosoh Corporation, having a molecular weight of $2.7\times10^2$ to $6.2\times10^6$. The detector is a refractive index (RI) detector. The columns are, for example, combinations of TSKgel G1000H, G2000H, G2500H, G3000H, G4000H, G5000H, G6000H, G7000H and GMH, all of which are available from Tosoh Corporation.

The main peak molecular weight of the binder resin generally is 1000 to 30,000, preferably 1500 to 10,000, more preferably 2000 to 8000. If the component having a molecular weight of lower than 1000 increases in the binder resin, the thermal storability of the toner containing the binder resin will become low; and if the component having a molecular weight of not lower than 30,000 increases, the low-temperature fixing ability of the toner generally lowers. However, it will be possible to prevent as much as possible the reduction in the low-temperature fixing ability of the toner by controlling the molecular weight balance of the binder resin. The content of the resin component having a molecular weight of 30,000 or more in the toner may be 1% or more, but preferably 3 to 6% though depending on the other components of the toner. If the content of the high-molecular resin component is smaller than 1%, the hot-offset resistance of the toner will become low; but if larger than 10%, the glossiness and the transparency of the toner will become low.

Preferably, Mn of the binder resin is 2000 to 15,000, and the ratio Mw/Mn thereof is 10 or less. If the ratio Mw/Mn is higher than 10, the microscopic miscibility of the resin will become low and the glossiness of the toner will therefore lower. Resin having Mn of smaller than 2000 will cause a problem in that, depending on the dispersant used along with it, the low-molecular component of the resin will contaminate the toner carrier. Resin having Mn exceeding 15,000 will increase the oily viscosity of the toner slurry being produced, and the colorant could not well disperse in the toner slurry. If so, when a color toner is prepared, its color reproducibility will be poor. For improving the releasing ability of the colorant, the amount of the releasing agent to be in the toner may be reduced, and in place of it, the binder resin to be in the toner may be so formed that it contains 1 to 15% of THF insolubles. In this case, the hot-offset resistance of the toner may be improved. When wax is used for the releasing agent, the releasing ability of the toner will increase, but its disadvantage is that too much wax will bleed out on the surfaces of the toner particles, and the flowability of the toner will become low. In this embodiment, the charge stability of the toner will become low in one case, or wax will adhere to the toner carrier to lower the durability of the toner carrier in another case. In these cases, if the amount of the releasing agent in the toner is well balanced with the other components of the toner, the THF insolubles in the binder resin will act to improve the releasing ability of the toner. The method of measuring the THF insolubles in the binder resin is described below.

Method of Measuring THF Insolubles in Binder Resin

About 1.0 g (A) of the binder resin or the toner is sampled, and its weight is measured.

About 50 g of THF is added to it, and kept at 20° C. for 24 hours.

This is first centrifuged, and then filtered through filter paper for quantification, JIS Standard (P3801), 5-C.

The resulting filtrate is dried in vacuum to remove the solvent, and the amount of the residue of resin alone (B) is measured.

This residue is the THF solubles.

The amount of the THF insolubles (%) in the binder resin in the toner is obtained according to the following equation.

$$\text{Amount of THF insolubles } (\%)=(A-B)/A\times 100$$

In case where the toner is sampled and analyzed for the THF insolubles in the binder resin, the amount of the THF insolubles except resin (W1) in the toner and the amount of the THF solubles except resin (W2) are separately determined in known methods, and the THF insolubles in the binder resin in the toner is obtained according to the following equation.

$$\text{Amount of THF insolubles } (\%)=(A-B-W2)/(A-W1-W2)\times 100$$

Method of Preparing the Toner of the Present Invention

Next described is the method of preparing the toner of the present invention.

The toner is prepared by dissolving or dispersing a toner composition that contains at least a polyester resin or modified polyester resin and a colorant and optionally contains a releasing agent, in an organic solvent, followed by granulating the composition in an aqueous medium. Alternatively, a polyester (i) modified with urea bonds may be used for preparing the toner, for which the polyester is subjected to polyaddition while the toner composition containing it is granulated.

The modified polyester resin is meant to indicate polyester resins with any other bonding group than ester bonds therein, or those with any other resin component of different structures covalent-bonded or ion-bonded thereto. For example, such modified polyester resins are prepared by reacting the polyester terminals with any others than ester bonds. Concretely, they are prepared by introducing a functional group such as an isocyanate group capable of reacting with an acid group or a hydroxyl group into the terminals of a polyester resin followed by further reacting with an active hydrogen compound to thereby modify the terminals of the polyester resin. Examples of the modified polyester resin are reaction products of an isocyanate group-having polyester prepolymer (A) and an amine (B).

One example of the compound having plural active hydrogen groups is prepared by bonding plural polyesters at their terminals, and it includes, for example, urea-modified polyesters and urethane-modified polyesters.

Another example of the resin is prepared by introducing a reactive group with a double bond into the backbone chain of a polyester followed by further introducing thereinto a graft component bonding to the side chains thereof via a carbon-carbon bond through radical polymerization at the reactive group, and it includes, for example, styrene-modified polyesters and acryl-modified polyesters.

Still another example of the resin is prepared by copolymerizing a polyester at the backbone chain thereof with a resin component of a different structure, for example, with a silicone resin modified with any of a carboxyl group, a hydroxyl group, an epoxy group or a mercapto group at its terminals, and it includes, for example, silicone-modified polyesters.

The isocyanate group-having polyester prepolymer (A) includes those prepared through reaction of an active hydrogen group-having polycondensate polyester of a polyol (1) and a polycarboxylic acid (2), with a polyisocyanate (3). The active hydrogen group which the polyester possesses includes, for example, a hydroxyl group (including an alcoholic hydroxyl group and a phenolic hydroxyl group), an amino group, a carboxyl group and a mercapto group. Of those, preferred is an alcoholic hydroxyl group.

The polyol (1) includes diols (1-1) and tri- and other higher polyols (1-2). (1-1) may be preferably used either alone or in combination. Diols (1-1) include, for example, alkylene glycols (e.g., ethylene glycol, 1,2-propylene glycol, 1,3-propylene glycol, 1,4butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); adducts of alkylene oxides (e.g., ethylene oxide, propylene oxide, butylene oxide) to the alicyclic diols; and adducts of alkylene oxides (e.g., ethylene oxide, propylene oxide, butylene oxide) to the bisphenols. Of those, preferred are alkylene glycols having 2 to 12 carbon atoms, and alkylene oxide adducts to bisphenols; and more preferred are alkylene oxide adducts to bisphenols combined with alkylene glycols having 2 to 12 carbon atoms. Tri- and other higher polyols (1-2) include, for example, trihydric to octahydric and other polyhydric aliphatic alcohols (e.g., glycerin, trimethylolethane, trimethylolpropane, pentaerythritol, sorbitol); trihydric and other polyhydric phenols (e.g., trisphenol PA, phenol-novolak, cresol-novolak); and alkylene oxide adducts to the trihydric and other polyhydric phenols.

The polycarboxylic acid (2) includes dicarboxylic acids (2-1) and trihydric and other polyhydric carboxylic acids (2-2). (2-1) may be preferably used either alone or in combination. Dicarboxylic acids (2-1) include, for example, alkylenedicarboxylic acids (e.g., succinic acid, adipic acid, sebacic acid); alkenylenedicarboxylic acids (e.g., maleic acid, fumaric acid); and aromatic dicarboxylic acids (e.g., phthalic acid, isophthalic acid, terephthalic acid, naphthalenedicarboxylic acid). Of those, preferred are alkenylenedicarboxylic acids having 4 to 20 carbon atoms, and aromatic dicarboxylic acids having 8 to 20 carbon atoms. Trihydric and other polyhydric carboxylic acids (2-2) include, for example, aromatic polycarboxylic acids having 9 to 20 carbon atoms (e.g., trimellitic acid, pyromellitic acid). If desired, anhydrides or lower alkyl esters (e.g., methyl esters, ethyl esters, isopropyl esters) of polycarboxylic acids (2) such as those mentioned above may be reacted with polyols (1).

The ratio of the polyol (1) to the polycarboxylic acid (2) represented in terms of equivalent ratio of the hydroxyl group [OH] to the carboxyl group [COOH], defined by [OH]/[COOH] falls within the range of 2/1 to 1/1, preferably 1.5/1 to 1/1, and more preferably 1.3/1 to 1.02/1.

The polyisocyanate (3) includes, for example, aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); araliphatic diisocyanates (e.g., $\alpha,\alpha,\alpha',\alpha'$-tetramethylxylylene diisocyanate); isocyanurates; the polyisocyanates blocked with any of phenol derivatives, oximes or caprolactams; and mixtures of two more of these.

The ratio of the polyisocyanate (3) to the polyester to be reacted with it is generally 5/1 to 1/1, preferably 4/1 to 1.2/1, more preferably 2.5/1 to 1.5/1, in terms of the equivalent ratio of the isocyanate group [NCO] of the former to the hydroxyl group [OH] of the latter having a hydroxyl group, [NCO]/[OH]. If the ratio of [NCO]/[OH] is larger than 5, the low-temperature fixing ability of the toner containing the binder resin will become low. On the other hand, if the molar ratio of [NCO] is smaller than 1, the urea content of the modified polyester lowers, and, as a result, the hot-offset resistance of the toner will become low. The content of the constitutive component, polyisocyanate (3) in the prepolymer (A) terminated with an isocyanate group is generally 0.5 to 40% by weight, preferably 1 to 30% by weight, more preferably 2 to 20% by weight. If the content is smaller than 0.5% by weight, the hot-offset resistance of the toner will become low and, in addition, both the thermal storability and the low-temperature fixing ability of the toner will also lower. On the other hand, if the content is larger than 40% by weight, the low-temperature fixing ability of the toner will become low.

The number of the isocyanate groups in one molecule of the isocyanate group-having prepolymer (A) is generally at least one, preferably 1.5 to 3, more preferably 1.8 to 2.5 in average. If it is smaller than 1 in one molecule, the molecular weight of the urea-modified polyester will increase, and the isocyanate group-having prepolymer will be ineffective for improving the hot-offset resistance of the toner.

The amines (B) are, for example, diamines (B1), trihydric and other polyhydric amines (B2), aminoalcohols (B3), aminomercaptans (B4), amino acids (B5), and blocked amines (B6) prepared by blocking the amino group in B1 to B5. Diamines (B1) include, for example, aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diaminecyclohexane, isophoronediamine); and aliphatic diamines (e.g., ethylenediamine, tetramethylenediamine, hexamethylenediamine). Trihydric and other polyhydric amines (B2) include, for example, diethylenetriamine, triethylenetetramine. Aminoalcohols (B3) include, for example, ethanolamine and hydroxyethylaniline. Aminomercaptans (B4) include, for example, aminoethylmercaptan and aminopropylmercaptan. Amino acids (B5) include, for example, aminopropionic acid and aminocaproic acid. Blocked amines (B6) prepared by blocking the amino group in B1 to B5 include, for example, ketimine compounds and oxazoline compounds obtained from amines of B1 to B5 mentioned above and ketones (e.g., acetone, methyl ethyl ketone, methyl isobutyl ketone). Of those amines (B), preferred are B1, and mixtures of B1 with minor B2.

If desired, the molecular weight of the urea-modified polyesters may be controlled with a chain extension stopper. The chain extension stopper includes, for example, monoamines (e.g., diethylamine, dibutylamine, butylamine, laurylamine), and their blocked derivatives (e.g., ketimine compounds).

Regarding the ratio of the amine (B) to the isocyanate group-having prepolymer (A) to be reacted with it, the equivalent ratio of the isocyanate group [NCO] in the prepolymer (A) to the amino group [NHx] in the amine (B), [NCO]/[NHx] is generally 1/2 to 2/1, preferably 1.5/1 to 1/1.5, more preferably 1.2/1 to 1/1.2. If [NCO]/[NHx] is larger than 2 or smaller than 1/2, the molecular weight of the urea-modified polyester (i) decreases, and, as a result, the hot-offset resistance of the toner will become low. In the present invention, the urea bond-modified polyester (i) may have an urethane bond in addition to the urea bond. The molar ratio of the urea bond content of the polymer to the urethane bond content thereof is generally 100/0 to 10/90, preferably 80/20 to 20/80, more preferably 60/40 to 30/70. If the molar ratio of the urea bond content of the polymer is smaller than 10%, the hot-offset resistance of the toner will become low.

In the present invention, the toner binder may be the urea bond-modified polyester (i) alone or may be a mixture of (i) with any other non-modified polyester (ii). The combination of (i) and (ii) is preferred to (i) alone, since it is effective for improving the low-temperature fixing ability of toner, especially the glossiness of color toner for use in full-color processors. (ii) includes, for example, polycondensates of polyols (1) and polycarboxylic acids (2) such as those in the polyester component (i). The preferred examples of (ii) are those mentioned above for (i). (ii) is not limited to non-modified polyesters only, and may include polyesters modified with any other chemical bond than urea bonds, for example, those modified with urethane bonds.

It is desirable that (i) and (ii) are at least partly miscible with each other in view of the low-temperature fixing ability and the hot-offset resistance of the toner containing them.

Accordingly, it is desirable that the polyester components (i) and (ii) are similar to each other in terms of their polyester structures. In case where (i) is combined with (ii), the weight ratio of (i) to (ii) is generally 5/95 to 80/20, preferably 5/95 to 30/70, more preferably 5/95 to 25/75, even more preferably 7/93 to 20/80. If the weight ratio of (i) is smaller than 5%, the hot-offset resistance of the toner will become low, and, in addition, both the thermal storability and the low-temperature fixing ability of the toner will also lower.

Preferably, the hydroxyl value of (ii) is 5 or more, more preferably 10 to 120, even more preferably 20 to 80. If it is smaller than 5, the thermal storability and the low-temperature fixing ability of the toner will become low. The acid value of (ii) is generally 1 to 30, preferably 5 to 20. Having the defined acid value, (ii) will negatively charge the toner.

In the present invention, the toner binder has a glass transition point (Tg) generally ranging from 55 to 75° C., preferably from 55 to 65° C. If Tg of the toner binder is lower than 55° C., the thermal storability of the toner will become low; but if higher than 75° C., the low-temperature fixing ability thereof will become low. Containing the urea-modified polyester resin, the thermal storability of the dry toner of the present invention is good even though the glass transition point thereof is low, as compared with known polyester toners.

The glass transition point (Tg) of the resin is measured with SEIKO EXSTAR6000TG/DTA6200. Concretely, the resin is heated at a rate of 10° C./min up to 200° C., and after one thermal history, its glass transition point is measured.

Releasing Agent:

Wax in the toner of the present invention is preferably a low-melting-point wax of which the melting point is 60 to 120° C. Wax of the type well disperses in the binder resin in the toner and serves more effectively as a releasing agent in the interface between fixing rollers and the toner, and, as a result, the toner exhibits good hot-offset resistance even though any external releasing agent such as oil is not applied to fixing rollers.

Wax having a melting point of higher than 120° C. is unfavorable since its lubricating effect is not good; and wax having a melting point of lower than 60° C. is also unfavorable since it worsens the storability and the blocking resistance of the toner. The melting point of wax for use in the present invention is indicated by the maximum endothermic peak thereof in differential scanning calorimetry (DSC).

For the wax component that functions as the releasing agent in the present invention, usable are the following materials. Concretely, the releasing agent for use herein includes tallows and waxes, for example, vegetable waxes such as carnauba wax, cotton wax, Japan wax, rice wax; animal waxes such as beeswax, lanolin; mineral waxes such as ozokerite; and petroleum waxes such as paraffin wax, microcrystalline wax, petrolatum. Apart from these natural waxes, also usable herein are synthetic hydrocarbon waxes such as Fisher-Tropsch wax, polyethylene wax; and other synthetic waxes such as esters, ketones, ethers. Further usable are aliphatic amides such as 12-hydroxystearaide, stearamide, anhydrous phthalimide, aliphatic amides having chlorohydrocarbon groups; as well as crystalline polymers having long alkyl branches, for example, low-molecular crystalline polymer resins such as polyacrylate homopolymers (e.g., poly-n-stearyl methacrylate, poly-n-lauryl methacrylate) and copolymers (e.g., n-stearyl acrylate-ethyl methacrylate copolymers).

Of those, vegetable waxes having Mw of 400 to 5000 and an acid value of 1 to 30 are favorable to color toners, since they suitably disperse in polyester resins to form fine transparent particles favorable for color toners. Ester waxes into which the needle penetration is 3 or les are also suitable to color toners, as they are colorless and odorless by themselves. In general, color toners for use in OHP must be transparent for image presentation through OHP sheets. If the needle penetration into color toners is larger than 3, the color toner fixing ability is not good.

The needle penetration into toner is an index of the thermal storability of toner, and it is measured according to the test method mentioned below.

Test Method for Thermal Storage:

10 g of toner to be tested is put into a glass bottle having an inner diameter of 25 mm and a height of 70 mm, and this is kept in a thermostat at 50° C. for 24 hours. After thus stored, the needle penetration into the toner is measured with a penetrometer of JSK2530.

It has been confirmed that the toner transparency depends on the dispersion unit, the dispersed particle diameter and the dispersion morphology of wax in the toner. Belt fixing units are inferior to roller fixing units in terms of toner fixing, since the surface pressure for toner fixing in the former is lower than that in the latter. In the former, therefore, the action of the releasing agent in the toner is more important than in the latter. To solve the problem of toner transparency, the dispersion unit of wax particles in the toner is so controlled that the particle diameter and the morphology of the wax particles in each toner particle have no influence on the toner transparency, and, in addition, the dispersion condition of wax particles in the binder resin is also suitably controlled so as to solve the problem of toner transparency irrespective of the degree of crystallinity of wax. The wax parameters have significant influences not only on the toner transparency but also on the hot-offset resistance of toner.

The dispersibility of wax in the toner of the present invention prepared according to method mentioned hereinabove (granulation in aqueous medium) significantly differs from that of ordinary toner prepared in a premix grinding method or a polymerization method. Specifically, in a premix grinding method, fine dispersion of ground toner particles is limited, and it is not easy to produce fine toner particles having a particle diameter of 2 $\mu$m or less. In addition, in the method, the grinding stress is often concentrated on the interface between wax and resin, and therefore wax is often released out of the surfaces of the toner particles. Thus released out, the wax is effective for lubricating the toner particles and therefore for preventing hot offsetting, but is disadvantageous to the transparency of color toners. On the other hand, in toner particles prepared through suspension polymerization, wax is enveloped in resin through vinyl polymerization, and it is almost ineffective for improving the transparency of the toner particles prepared. Also in emulsion polymerization to prepare toner particles, it is in fact almost impossible to fine disperse wax in the toner particles produced through vinyl polymerization. Contrary to these methods, the method of preparing the toner of the present invention is favorable for finely dispersing wax particles in toner particles, since the shape, the morphology and the particle diameter of the wax particles to be finely dispersed in the toner particles can be relatively easily controlled. The shape, diameter and the state of wax particle existing in the toner particle affects fixing quality, specifically fixing temperature (hot offsetting) in the belt fixing where fixing in low surface pressure is desired. That is, when the wax particle exists in the vicinity of the particle surface, specifically when the wax particle exists along the surface layer of the toner particle, wax may promptly permeate into the surface of the toner particle to show satisfying releasing ability while there is a problem of wax particle tends to expose at the surface of the toner particle. On the other hand, when the wax particle is dispersed deep inside the toner particle, hot offset resistance deteriorates due to permeation of the wax particle into the surface of the toner particle becomes difficult, hence releasing ability deteriorates.

A well balanced state of the wax particle in the toner particle is to have the wax particle exist in the vicinity of the surface of the toner particle to orient the maximum diameter of the wax particle to the direction of the toner particle core in acicular-like state, so that exposing of wax particles at the surface of the toner particle is likely be suppressed, and are well dispersed to easily permeate under heat at the time of fixing. Such state of dispersion of wax particles in the toner particle is realized by dispersing 10 to 200% of wax dispersant to the wax so as to disperse wax against polyester or modified polyester to form islands of wax and resin (polyester or modified polyester). A suitable wax dispersant may be styrene and acryl copolymers, such as copolymer of styrene, nBMA, and BA (MW50000), or copolymer of styrene and BA (MW80000). When the amount of dispersant is large with respect to the wax, wax particles are dispersed deep inside the toner particle while the amount thereof is less, wax particles are dispersed in the vicinity of the toner surface.

A method for measuring the dispersed particle diameter of wax in the toner of the present invention is described concretely.

In the present invention, the dispersed particle diameter of wax is indicated by the major diameter of each wax particle dispersed in toner particles. Concretely, a sample of the toner is embedded in an epoxy resin, and it is cut into ultra-thin slices of about 100 $\mu$m thick. Stained with ruthenium tetroxide, the slice is observed with a transmission electronic microscope (TEM) having a magnification of 1000 to 10,000, and its picture is taken through the microscope. The image of the picture is analyzed to know the wax dispersion condition in toner particles and to measure the dispersed particle diameter of the wax particles.

The wax dispersion distribution in the toner of the present invention is preferably such that wax particles of 0.1 to 2 $\mu$m in particle diameter account for 70% or more by number, more preferably those of 0.5 $\mu$m to 1 $\mu$m account for 70% or more by number. The reason why such wax particles not smaller than 0.1 $\mu$m are preferred is because their lubricating ability is good. If large wax particles having a maximum length of larger than 3 $\mu$m account for 5% or more of all wax particles, they will aggregate and lower the flowability of the toner. If so, in addition, such large wax particles cause a problem of toner filming, and greatly lower the color reproducibility and the glossiness of color toners. For these reasons, such large wax particles are unfavorable in the present invention.

Also preferably, the wax particles are relatively uniformly dispersed inside the toner particles, and 3 wax particles or more are in one toner particle. In addition, in view of the fixing ability and the releasing ability of the toner, it is also desirable that the toner particles each carrying less than 3 wax particles therein do not exceed 30% by number of all the toner particles seen in the TEM picture.

Referring to the wax dispersion condition in the toner particles seen in the TEM picture, the wax particles are preferably so oriented in each toner particle that the major diameter of each wax particle is not parallel to the surface of the toner particle, or that is, the wax particles are dispersed toward the inside of the toner particle. This is because the toner particles with wax particles dispersed inside them are well flowable and their charge fluctuation is relatively small, but those in which the wax particles extend along the particle surface and are exposed has a problem in the charge stability and the flowability as seen in ground toner particles, while satisfies releasing ability.

Colorant

For the colorant for the toner of the present invention, employable are all known dyes and pigments. For example, herein employable are carbon black, nigrosine dye, iron black, Naphthol Yellow S, Hansa Yellow (10G, 5G, G), cadmium yellow, yellow iron oxide, ochre, chrome yellow, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), tartrazine lake, quinoline yellow lake, Anthrazan Yellow BGL, isoindolinone yellow, red iron oxide, red lead, lead vermilion, cadmium red, cadmium mercury red, antimony red, Permanent Red 4R, para red, fire Red, parachloro-orthonitroaniline red, Lithol Fast Scarlet G, brilliant fast scarlet, Brilliant Carmine BS, Permanent Red (F2R, F4R, FRL, FRLL, F4RH), Fast Scarlet VD, Vulcan fast rubin B, Brilliant Scarlet G, Lithol Rubin GX, Permanent Red F5R, Brilliant Carmine 6B, Pigment Scarlet 3B, Bordeaux 5B, toluidine maroon, Permanent Bordeaux F2K, Helio Bordeaux BL, Bordeaux 10B, BON maroon light, BON maroon medium, eosine lake, Rhodamine Lake B, Rhodamine Lake Y, alizarine lake, Thioindigo Red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, Indanthrene Blue (RS, BC), indigo, ultramarine, prussian blue, anthraquinone blue, Fast Violet B, methyl violet lake, cobalt violet, manganese violet, dioxane violet, anthraquinone violet, chrome green, zinc green, chromium oxide, viridian, emerald green, Pigment Green B, Naphthol Green B, green gold, acid green lake, malachite green lake, phthalocyanine green, anthraquinone green, titanium oxide, zinc flower, lithopone, and their mixtures. The amount of the colorant to be in the toner may be generally 1 to 15% by weight, preferably 3 to 10% by weight of the toner.

The colorant used in the present invention may be used as master batch compounded with resin. The binder resin to be used in preparing the master batch or to be mixed with the master batch may be any of the above-mentioned, modified or non-modified polyester resins, as well as styrene polymers and substituted styrene polymers such as polystyrene, poly-chlorostyrene, polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymers; and polymethyl methacrylate, polybutyl methacrylate, polyvinyl chloride, polyvinyl acetate, polyethylene, polypropylene, polyesters, epoxy resins, epoxy-polyol resins, polyurethanes, polyamides, polyvinylbutyral, polyacrylic acid resins, rosin, modified rosins, terpene resins, aliphatic or alicyclic hydrocarbon resins, aromatic petroleum resins, chloroparaffins, paraffin wax. These may be used alone or in combination.

The master batch may be prepared by mixing and kneading the resin for master batch and the colorant with high shear force being applied thereto. In this case, an organic solvent may be added to the mixture for improving the interaction between the colorant and the resin. A flashing method is favorable to preparing the master batch, which comprises premixing an aqueous paste of colorant with resin along with an organic solvent to thereby transfer the colorant to the resin phase, followed by removing water and the organic solvent from the resulting premix. In this method, wet cake of colorant can be directly used, not dried. For premixing the components, preferred is a high-shear dispersing device such as a three-roll mill.

Charge-controlling Agent:

If desired, the toner of the present invention may contain a charge-controlling agent. For the charge-controlling agent, herein usable are all known ones. For example, it includes nigrosine dyes, triphenylmethane dyes, chromium-containing metal complex dyes, molybdate chelate pigments, rhodamine dyes, alkoxyamines, quaternary ammonium salts (including fluoro-modified quaternary ammonium salts), alkylamides, phosphor and its compounds, tungsten and its compounds; fluorine-containing surfactants, metal salicylates, and metal salicylate derivatives. Concretely, they are Bontron 03, a type of nigrosine dye; Bontron P-51, a type of quaternary ammonium salt; Bontron S-34, a type of metal-containing azo dye; E-82, a type of hydroxynaphthoic acid-metal complex; E-84, a type of salicylic acid-metal complex; E-89, a type of phenolic condensate (these are all by Orient Chemical Industry); quaternary ammonium salt-molybdenum complexes, TP-302 and TP415 (these are by Hodogaya Chemical Industry); Copy Charge PSY VP2038, a type of quaternary ammonium salt; Copy Blue PR, a type of triphenylmethane derivative; quaternary ammonium salts, Copy Charge NEG VP2036 and Copy Charge NX VP434 (these are all by Hoechst); LRA-901; LR-147, a type of boron complex (these are by Nippon Carlit); as well as copper phthalocyanine, perylene, quinacridone and azo pigments, and other polymer compounds having a functional group of, for example, sulfonic acid groups, carboxyl groups or quaternary ammonium salts.

In the present invention, the amount of the charge-controlling agent to be in the toner is determined, depending on the type of the binder resin and the presence or absence of any optional additives in the toner, and on the method of preparing the toner including dispersing the constitutive components, and therefore could not be determined unconditionally. Preferably, however, the amount is 0.1 to 10 parts by weight, more preferably 0.2 to 5 parts by weight, relative to 100 parts by weight of the binder resin in the toner. If it is larger than 10 parts by weight, the toner will be too much charged, and will therefore detract from the effect of the principal charge-controlling agent essentially used in the method for fixing toner. If so, the static attraction force of the toner to the development roller will increase, the flowability of the developer used will decrease, and the image density will decrease. The charge-controlling agent and the releasing agent may be premixed with the master batch or the binder resin. Needless-to-say, these may be added to the toner components while they are dissolved or dispersed in an organic solvent.

Additive:

One preferred additive to the toner of the present invention for assisting the flowability, the developability and the charge property of the toner is inorganic particles. Preferably, the primary particle diameter of the inorganic particles is 5 mμ to 2 μm, more preferably 5 mμ to 500 mμ. Also preferably, the specific surface area of the inorganic particles, measured according to the BET method, is 20 to 500 $m^2/g$. The amount of the inorganic particles to be used is preferably 0.01 to 5% by weight of the toner, more preferably 0.01 to 2% by weight. Examples of the inorganic particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Especially preferably, hydrophobic silica particles are combined with hydrophobic titanium oxide particles for the flowability improver.

Especially when these two types of particles having a mean particle diameter of 50 mμ or less are combined to prepare a flowability improver and mixed with the toner by stirring them, the electrostatic force and the Van der Waals force of the flowability improver to the toner are significantly high. Therefore, even when the toner components are mixed along with the flowability improver by stirring them inside developing machines for obtaining the desired charge level, the flowability improver does not remove from the toner particles. As a result, the toner gives good images with no white spot, and, in addition, the untransferred toner residue is reduced. We, the inventors have clarified the advantages of the flowability improver.

Titanium oxide particles are favorable to the environment and are effective for stabilizing image density, but on the other hand, they are problematic in that the charge rise time is often long when they are used. Therefore, if the amount of titanium oxide particles is larger than that of silica particles when these two type of particles are combined to be a flowability improver, the negative influence of the side effect of titanium oxide particles on the toner fixing ability will be remarkable. However, when the amount of hydrophobic silica particles and hydrophobic titanium oxide particles is within the range of 0.3 to 1.5% by weight, it does not significantly detract from the charge rise of the toner, and the toner could have the desired charge rise characteristic. Accordingly, even when copying with the toner is repeated many times, it still gives good images of stable and high quality, and toner scattering is prevented. We, the inventors have also found the advantages of the flowability improver.

Method for Preparing Modified Polyester Resin:

The toner binder resin may be prepared according to the method mentioned below. A polyol (1) and a polycarboxylic acid (2) are heated at 150 to 280° C. in the presence of a known esterification catalyst such as tetrabutoxy titanate or dibutyltin oxide to obtain a hydroxyl group-having polyester while water given by the reaction is evaporated away optionally under reduced pressure. Next, the polyester is reacted with a polyisocyanate (3) at 40 to 140° C. to obtain an isocyanate group-having prepolymer (A). Further the prepolymer (A) is reacted with an amine (B) at 0 to 140° C. to obtain a polyester modified with urea bonds (i).

When the polyester is reacted with (3) and when (A) is reacted with (B), optionally used is a solvent The solvent is inert to the isocyanate (3), including, for example, aromatic solvents (e.g., toluene, xylene); ketones (e.g., acetone, methyl ethyl ketone, methyl isobutyl ketone); esters (e.g., ethyl acetate); amides (e.g., dimethylformamide, dimethylacetamide); and ethers (e.g., tetrahydrofuran). In case where the modified polyester (i) is combined with a polyester (ii) not modified with urea bonds for the binder resin, (ii) is prepared in the same manner as above for producing the hydroxyl group-having polyester, and this is dissolved in the solution of (i) and mixed with it after the reaction to give (i) has been completed.

The dry toner of the present invention may be prepared according to the method mentioned below, to which, the present invention is not limited.

Method for Preparing Toner in Aqueous Medium

The aqueous medium to be used in preparing the toner of the present invention may be water alone or may be a mixture of water with a water-miscible solvent. The water-miscible solvent includes, for example, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

To form the toner particles, a dispersion of the isocyanate group-having prepolymer (A) may be reacted with (B) in such an aqueous medium to give a binder resin, or alternatively, the urea-modified polyester (i) having been previously prepared may be used as the binder resin. For stabilizing the urea-modified polyester (i) or the dispersion of prepolymer (A) in an aqueous medium to form the toner particles, for example, a toner composition comprising the urea-modified polyester (i) or the prepolymer (A) is added to an aqueous medium and dispersed therein by shear force. The prepolymer (A) may be mixed with the other toner components (hereinafter referred to as toner materials), colorant, colorant master batch, releasing agent, charge-controlling agent, non-modified polyester resin and others, while its dispersion is formed in an aqueous medium. Preferably, however, the toner materials are previously mixed, and the resulting mixture is added to an aqueous medium that contains a dispersion of the prepolymer (A). In the present invention, it is not always necessary that the other toner materials such as colorant, releasing agent and charge-controlling agent are in the aqueous medium in which the toner particles are formed, but they may be added to the aqueous medium after the toner particles have been formed therein. For example, toner particles not containing a colorant are formed, and a colorant may be added thereto according to a known toner-coloring method.

The method of dispersing the toner materials is not specifically defined, for which, for example, usable are any known dispersers such as low-speed shearing dispersers, high-speed shearing dispersers, frictional dispersers, high-pressure jet dispersers, or ultrasonic dispersers. Of those, preferred are high-speed shearing dispersers for forming toner particles having a particle diameter of 2 to 20 $\mu$m. The number of revolutions of the high-speed shearing disperser is not specifically defined, for example, generally ranging from 1000 to 30,000 rpm, preferably 5000 to 20,000 rpm. The time for dispersing the toner materials is not also specifically defined, for example, generally ranging from 0.1 to 5 minutes for batch dispersion. The temperature at which the toner materials are dispersed may be generally 0 to 150° C. (under pressure), preferably 40 to 98° C. Higher temperatures are more preferred, at which the viscosity of the dispersion of the urea-modified polyester (i) or the prepolymer (A) is low and the component is easier to disperse.

The amount of the aqueous medium to be used herein may be generally 50 to 2,000 parts by weight, preferably 100 to 1000 parts by weight relative to 100 parts by weight of the toner composition that contains the urea-modified polyester (i) or the prepolymer (A). If it is smaller than 50 parts by weight, the toner composition could not well disperse in the aqueous dispersion, and the particle diameter of the toner particles formed could not reach a predetermined level. If, however, the amount of the aqueous medium is larger than 2,000, it is uneconomical. If desired, a dispersant may be added to the aqueous medium. Adding a dispersant thereto is preferred since the toner particles formed may have a sharper particle diameter distribution and their dispersion is more stable.

For the dispersant that promotes the emulsification and dispersion of the oily-phase toner dispersion in the aqueous medium, for example, usable are anionic surfactants such as salts of alkylbenzenesulfonic acids, salts of $\alpha$-olefinsulfonic acids, phosphates; amine-type cationic surfactants such as alkylamine salts, aminoalcohol-fatty acid derivatives, polyamine-fatty acid derivatives, imidazoline; quaternary ammonium salt-type cationic surfactants such as alkyltrimethylammonium salts, dialkyldimethylammonium salts, alkyldimethylbenzylammonium salts, pyridinium salts, alkylisoquinolinium salts, benzetonium chloride; nonionic surfactants such as fatty acid amide derivatives, polyhydric alcohol derivatives; and ampholytic surfactants such as alanine, dodecyldi(aminoethyl)glycine, di(octylaminoethyl) glycine, N-alkyl-N,N-dimethylammonium betaines.

Fluoroalkyl group-having surfactants are effective for the dispersant, even through their amount used is extremely small. Preferred examples of fluoroalkyl group-having anionic surfactants for use herein are fluoroalkyl($C_{2-10}$) carboxylic acids and their salts, disodium perfluorooctanesulfonylglutaminate, sodium 3-[omega-fluoroalkyl($C_{6-11}$)oxy]-1-alkyl($C_{3-4}$)sulfonates, sodium 3-[omega-fluoroalkaoyl($C_{6-8}$)-N-ethylamino]-1-propanesulfonates, fluoroalkyl($C_{11-20}$)carboxylic acids and their metal salts, perfluoroalkyl($C_{7-13}$)carboxylic acids and their salts, perfluoroalkyl($C_{4-12}$)sulfonic acids and their salts, perfluorooctanesulfonic acid diethanolamide, N-propyl-N-(2-hydroxyethyl)perfluorooctanesulfonamide, perfluoroalkyl($C_{6-10}$) sulfonamidopropyltrimethylammonium salts, perfluoroalkyl ($C_{6-10}$)-N-ethylsulfonylglycine salts, monoperfluoroalkyl ($C_{6-16}$)ethyl phosphates.

Their commercial products are, for example, Sarfron S-111, S-112, S-113 (by Asahi Glass); Frorard FC-93, FC-95, FC-98, FC-129 (by Sumitomo 3M); Unidyne DS-101, DS-102 (by Daikin Industries); Megafac F-110, F-120, F-113, F-191, F-812, F-833 (by Dai-Nippon Ink & Chemicals); Extop EF-102, 103, 104, 105, 112, 123A, 123B, 306A, 501, 201, 204 (by Tochem Products); and Ftergent F-100, F-150 (by Neos).

Examples of cationic surfactants usable herein are fluoroalkyl group-having primary, secondary or tertiary amines, aliphatic quaternary ammonium salts such as perfluoroalkyl ($C_{6-10}$)sulfonamidopropyltrimethylammonium salts, and benzalkonium salts, benzetonium chloride, pyridinium salts, imidazolinium salts. Their commercial products are, for example, Sarfron S-121 (by Asahi Glass); Frorard FC-135 (by Sumitomo 3M); Unidyne DS-202 (by Daikin Industries); Megafac F-150, F-824 (by Dai-Nippon Ink & Chemicals); Extop EF-132 (by Tochem Products), and Ftergent F-300 (by Neos).

Inorganic compounds hardly soluble in water are also usable for the dispersant herein, including, for example, tricalcium phosphate, calcium carbonate, titanium oxide, colloidal silica and hydroxyapatite.

If desired, the dispersion drops may be stabilized with a protective polymer colloid. The stabilizer includes, for example, homopolymers and copolymers of acids (e.g., acrylic acid, methacrylic acid, α-cyanoacrylic acid, α-cyanomethacrylic acid, itaconic acid, crotonic acid, fumaric acid, maleic acid, maleic anhydride), or OH-having (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, N-methylolmethacrylamide), or vinyl alcohols or vinyl alcohol ethers (e.g., vinyl methyl ether, vinyl ethyl ether, vinyl propyl ether), or esters of carboxyl-having compounds with vinyl alcohols (e.g., vinyl acetate, vinyl propionate, vinyl butyrate), or acrylamide, methacrylamide, diacetonacrylamide or their methylol compounds, or acid chlorides (e.g., acrylic chloride, methacrylic chloride), or nitrogen atom-having or heterocyclic monomers (e.g., vinylpyridine, vinylpyrrolidone, vinylimidazole, ethyleneimine); polyoxyethylene-type polymers such as polyoxyethylene, polyoxypropylene, polyoxyethylene aLkylamines, polyoxypropylene alkylamines, polyoxyethylene alkylamides, polyoxypropylene alkylamides, polyoxyethylene nonylphenyl ether, polyoxyethylenelaurylphenyl ether, polyoxyethylene stearylphenyl ester, polyoxyethylene nonylphenyl ester; and celluloses such as methyl cellulose, hydroxyethyl cellulose, hydroxypropyl cellulose.

From the emulsified dispersion, the organic solvent is removed. For this, for example, the system is gradually heated, and the organic solvent in the liquid drops therein is completely evaporated away. Alternatively, the emulsified dispersion may be sprayed into a dry atmosphere to completely remove the water-insoluble organic solvent from the liquid drops therein to form toner particles while, at the same time, the aqueous dispersant is also evaporated away from the toner particles. For the dry atmosphere into which the emulsified dispersion is sprayed, generally employed are various types of hot vapors of, for example, air, nitrogen, carbon dioxide or combustion gas, especially those heated at a temperature of the boiling point or more of the highest-boiling-point solvent used. Thus processed in a spray drier, a belt drier or a rotary kiln for a short period of time, the emulsified dispersion gives high-quality toner particles well satisfying the object of the present invention.

In case where a dispersion stabilizer soluble in acid or alkali, such as calcium phosphate is used, it may be dissolved in an acid such as hydrochloric acid and then the toner particles may be washed with water to thereby remove the dispersion stabilizer, calcium phosphate from the toner particles. Alternatively, it may also be removed from the toner particles through enzymolysis.

The dispersant may remain on the surfaces of the toner particles. However, in view of the charge property of the toner, the dispersant is preferably washed away after chain extension and/or crosslinking reaction of the binder resin in the toner particles.

For further lowering the viscosity of the toner composition, also usable is a solvent capable of dissolving the urea-modified polyester (i) and the polyester prepolymer (A). Using the solvent is preferred as it sharpens the particle diameter distribution of the toner particles formed. Preferably, the solvent is volatile, having a boiling point of lower than 100° C., as it is easy to remove. Examples of the solvent are toluene, xylene, benzene, carbon tetrachloride, chloromethylene, 1,2-dichloroethane, 1,1,2-trichloroethane, trichloroethylene, chloroform, monochlorobenzene, dichoroethylidene, methyl acetate, ethyl acetate, methyl ethyl ketone, and methyl isobutyl ketone. One or more of these may be used alone or in combination. Especially preferred are aromatic solvents such as toluene, xylene, and halogenohydrocarbons such as chloromethylene, 1,2-dichloroethane, chloroform, and carbon tetrachloride. The amount of the solvent to be used may be generally 0 to 300 parts, preferably 0 to 100 parts, more preferably 25 to 70 parts relative to 100 parts of the prepolymer (A). The solvent, if used, is removed by heating the system under atmospheric pressure or reduced pressure after chain extension and/or crosslinking reaction of the binder resin.

The time for chain extension and/or crosslinking reaction of the binder resin is determined in accordance with the reactivity of the isocyanate structure which the prepolymer (A) possesses with the amine (B) to be reacted with it, and it therefore varies, depending on the combination of the two. In general, the time is 10 minutes to 40 hours, preferably 2 to 24 hours. The reaction temperature is generally 0 to 150° C., preferably 40 to 98° C. If desired, any known catalyst may be used in the reaction. Concretely, for example, dibutyltin laurate or dioctyltin laurate may be used.

From the emulsified dispersion, the organic solvent is removed. For this, for example, the system is gradually heated, and the organic solvent in the liquid drops therein is completely evaporated away. Alternatively, the emulsified dispersion may be sprayed into a dry atmosphere to completely remove the water-insoluble organic solvent from the liquid drops therein to form toner particles while, at the same time, the aqueous dispersant is also evaporated away from the toner particles. For the dry atmosphere into which the emulsified dispersion is sprayed, generally employed are various types of hot vapors of, for example, air, nitrogen, carbon dioxide or combustion gas, especially those heated at a temperature of the boiling point or more of the highest-boiling-point solvent used. Thus processed in a spray drier, a belt drier or a rotary kiln for a short period of time, the emulsified dispersion gives high-quality toner particles well satisfying the object of the present invention.

In case where the particle diameter distribution of the emulsified dispersion is broad, and the dispersion is washed and dried while it has such a broad particle diameter distribution, the resulting particles may be classified and dressed to select those having a desired particle diameter distribution.

For example, the particles still in liquid are processed in a cyclone, a decanter or a centrifuge to remove fine powdery particles from them. Needless-to-say, the particles may be classified after dried. In view of the efficiency of the classifier used, it is desirable that the particles still in liquid are directly classified as they are. Thus separated, the unnecessary fine powdery particles or coarse particles are recirculated into the premixing step and are used for forming toner particles. In this case, the powdery particles and the coarse particles may be wet.

Thus obtained, the dry toner particles are mixed with additive particles such as releasing agent particles, charge-controlling agent particles, flowability improver particles and colorant particles and the resulting mixture is optionally exposed to mechanical impact applied thereto, whereby the additive particles are well fixed and fused to the surfaces of the toner particles so as not to drop off from the surfaces of the resulting composite particles of toner.

Concretely, for example, the mixture is put in a stirrer, in which the stirring blades are rotated at high speed to impart impact force to the mixture therein; or the mixture is led into jet streams and accelerated so as to make the toner particles or the composite toner particles collide with each other or against collision baffles. For the purpose, various devices may be used, for example, Angmill (by Hosokawa Micron) and I-type Mill (by Nippon Pneumatic) that are modified to lower the attrition air pressure therein, as well as Hybridization System (by Nara Machinery Manufacturing), Cryptoron (by Kawasaki Heavy Industries), and automatic mortars.

Carrier for Two-component Developer

In case where the toner of the invention is used for a two-component developer, it may be mixed with a magnetic carrier. Regarding the blend ratio of toner to carrier in the developer, it is desirable that the amount of the toner is 1 to 10 parts by weight relative to 100 parts by weight of the carrier. The magnetic carrier may be any known one, including, for example, iron powder, ferrite powder, magnetite powder or magnetic resin carrier having a particle diameter of 20 to 200 μm or so. The carrier particles may be coated with any of amino resin, e.g., urea-formaldehyde resin, melamine resin, benzoguanamine resin, urea resin or polyamide resin, or epoxy resin. For the coating material, also usable are polyvinyl or polyvinylidene resin such as acrylic resin, polymethyl methacrylate resin, polyacrylonitrile resin, polyvinyl acetate resin, polyvinyl alcohol resin, polyvinyl butyral resin; polystyrene resin and other polystyrenic resin such as styrene-acrylic copolymer resin; haloolefinic resin such as polyvinyl chloride; polyester resin such as polybutylene terephthalate resin; polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride; fluoro-terpolymer such as terpolymer of tetrafluoroethylene, vinylidene fluoride and non-fluoro monomer; and silicone resin. If desired, electroconductive powder may be in the coating resin. The electroconductive powder includes, for example, metal powder, carbon black, titanium oxide, tin oxide, zinc oxide. Preferably, the electroconductive powder has a mean particle diameter of 1 μm or less. If its mean particle diameter is larger than 1 μm, the electric resistance of the resin-coated carrier particles will be difficult to control. Not combined with such a carrier, the toner of the present invention may also be a one-pack magnetic or non-magnetic toner.

Method of Measuring the Roundness of Toner:

It is a matter of importance that the toner particles of the present invention have a mean roundness of 0.96 to 1.00 and have a specific morphology and a specific morphology distribution. If their mean roundness is smaller than 0.96, the toner particles are far from spheres and will be amorphous. Toner of which the particles having a roundness of smaller than 0.95 account for 30% or more of all the particles could not meet the recent requirement in the art of giving high-quality images. Amorphous toner particles have many contact points with flat media such as photoconductor, and their hilltops will receive much charge concentrated thereto. As a result, the attracting force such as Van der Waals force or image force of amorphous toner particles is higher than that of spherical toner particles. Accordingly, when a toner containing both amorphous particles and spherical particles is used in an electrostatic image-transferring step, the spherical toner particles selectively migrate to cause non-image spots in the letter or line images formed. One method of measuring the roundness of toner particles is described hereinunder.

For analyzing the morphology of toner particles, for example, suitable is a method of optical inspection that comprises letting a particle suspension into an image pickup zone on a flat plate, taking an optical image of the particles with a CCD camera, and analyzing the image. The circumferential length of a circle of which the area is the same as the projected area of the particle image analyzed herein is divided by the circumferential length of the projected area of the particle itself, and it gives the roundness of the particle. We, the present inventors have found that a toner having a mean roundness of 0.96 or more and contains 30% or less of particles having a mean roundness of smaller than 0.95 is effective for forming reproducible high-precision images of good density. More preferably, the toner has a mean roundness of 0.98 to 1.00 and contains 10% or less of particles having a mean roundness of smaller than 0.95. The mean particle roundness of toner can be measured with a flow particle image analyzer, FPIA-2100 (by Toa Medical Electronics). Concretely, 0.1 to 0.5 ml of a surfactant that serves as a dispersant, preferably a salt of an alkylbenzenesulfonic acid is added to 100 to 150 ml of water from which solid impurities have been previous removed, in a container, and then about 0.1 to 0.5 g of a toner sample to be analyzed is added thereto. The resulting suspension thus containing the sample dispersed therein is then further dispersed in an ultrasonic disperser for about 1 to 3 minutes to prepare a toner dispersion having a concentration of 3000 to 10,000 particles/μl, and this is analyzed using the above-mentioned image analyzer to determine the particle morphology and the particle dispersion distribution of the toner sample.

EXAMPLES

The present invention is described in more detail with reference to the following Examples, which, however, are not intended to restrict the scope of the present invention. In the following, "parts" are all by weight.

The physical properties of the toners prepared and used in the Examples are shown in Table 1 below.

Example 1

Preparation of Toner Binder 780 parts of bisphenol A-ethylene oxide (2 mols) adduct, 280 parts of isophthalic acid and 2 parts of dibutyltin oxide were put into a reactor equipped with a condenser tube, a stirrer and a nitrogen-introducing duct, and reacted therein for 6 hours at 230° C. under atmospheric pressure, and then for 3 hours under a reduced pressure of 10 to 15 mmHg. After this was cooled to 160° C., 32 parts of phthalic anhydride was added thereto and reacted for 2 hours. Next, this was cooled to 80° C., and reacted with 198 parts of isophorone diisocyanate in ethyl acetate for 2 hours to give an isocyanate-having prepolymer (1). Next, 267 parts of the prepolymer (1) was reacted with 12 parts of isophoronediamine at 50° C. for 2 hours to give an urea-modified polyester (1) having a weight-average molecular weight of 54,000. In the same manner as above, 724 parts of bisphenol A-ethylene oxide (2 mols) adduct and 276 parts of terephthalic acid were polycondensed at 230° C. under atmospheric pressure for 8 hours and then further reacted for 5 hours under a reduced pressure of 10 to 15 mmHg to give a non-modified polyester (a) having a peak molecular weight of 5000. 100 parts of the urea-modified polyester (1) and 900 parts of the non-modified polyester (a) were mixed by dissolving them in 1800 parts of a solvent ethyl acetate to give a solution of toner binder (1) in ethyl acetate. This was partly dried under reduced pressure to isolate the toner binder (1).

Production of Toner 210 parts of the ethyl acetate solution of toner binder (1), 20 parts of pentaerythritol tetrabehenate (melting point 81°

Figure 4:
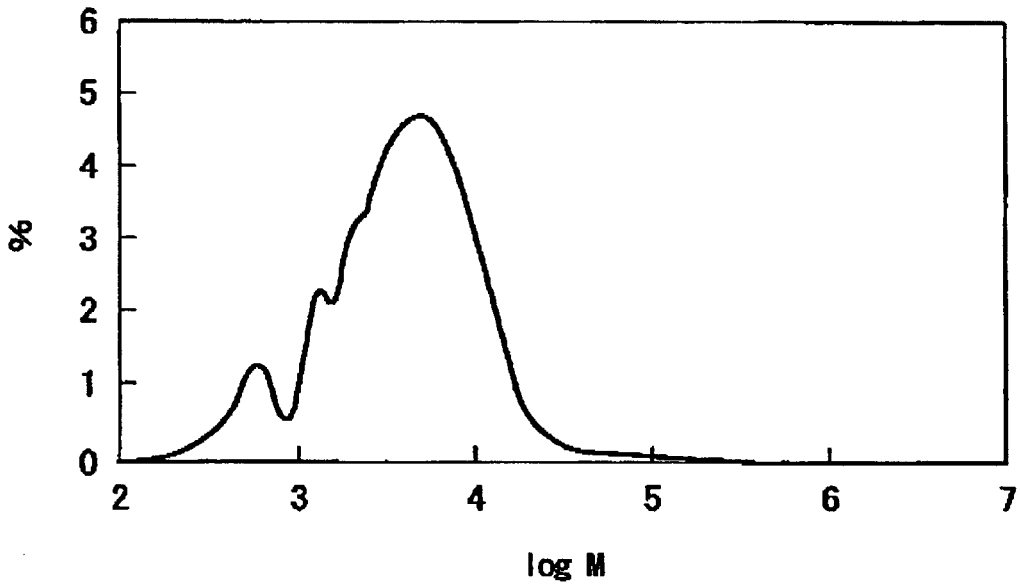
FIG. 4 is a GPC chromatogram of the toner prepared in Example 1.
Figure 5:
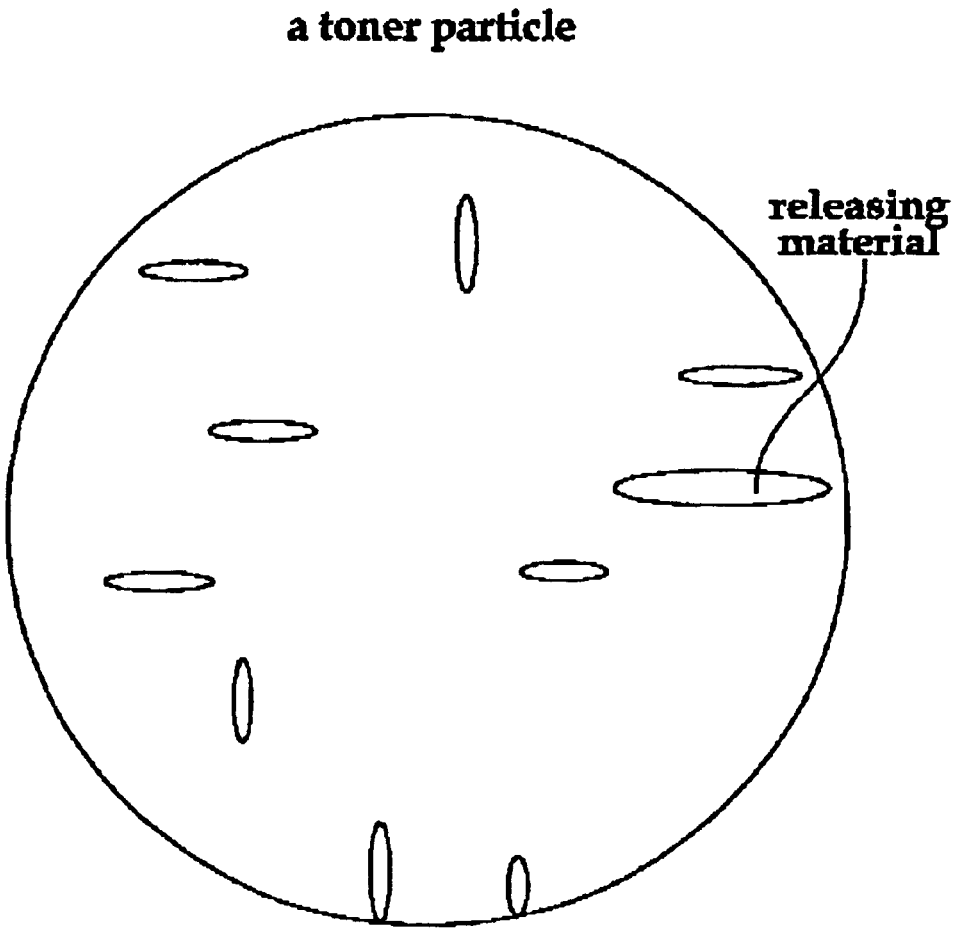
FIG. 5 is a cross-sectional view of the toner particle prepared in Example 1.

C., needle penetration 2.4, molecular weight 4200, acid value 4.0), and 4 parts of copper phthalocyanine blue pigment were put into a beaker, and these were uniformly dissolved and dispersed by stirring them at 60° C. with a TK-type homomixer at 12,000 rpm. On the other hand, 706 parts of ion-exchanged water, 260 parts of 10% hydroxyapatite suspension (Nippon Chemical Industry's Supertite 10), and 0.2 parts of sodium dodecylbenzenesulfonate were put into a beaker and uniformly dissolved. Next, this was heated up to 60° C., and with stirring it with a TK-type homomixer at 12,000 rpm, the toner material solution prepared in the above was added thereto, and stirred for 10 minutes. The resulting mixture was transferred into a flask equipped with a stirring rod and a thermometer, and gently stirred for 3 hours with heating up to 98° C. to remove the solvent. This was filtered, washed and dried, and then pneumatically classified to obtain toner particles having a weight-average particle diameter of 6 μm. Next, 100 parts of the toner particles were mixed with 0.5 parts of hydrophobic silica and 0.5 parts of hydrophobic titanium oxide using a Henschel mixer to obtain a toner (1) of the present invention. Its GPC chromatograph is FIG. 4, and its test data are given in Table 2 below. At least 3 wax particles were in each toner particle, in which wax particles having a dispersed particle diameter of 0.1 to 2 μm accounted for 90% of all the wax particles therein. No wax particles of 3 μm or larger were found in the toner particles. The orientation of the wax particles dispersed in the toner particles was as in FIG. 5.

Example 2

Preparation of Toner Binder

In the same manner as in Example 1, 314 parts of bisphenol A-ethylene oxide (2 mols) adduct, 314 parts of bisphenol A-propylene oxide (2 mols) adduct and 20 parts of trimellitic anhydride were polycondensed, and then reacted with 154 parts of isophorone diisocyanate to give a prepolymer (2). Next, 213 parts of the prepolymer (2) was reacted with 9.5 parts of isophoronediamine and 0.5 parts of dibutylamine also in the same manner as in Example 1 to give an urea-modified polyester (2) having a weight-average molecular weight of 79,000. 200 parts of the urea-modified polyester (2) and 800 parts of the non-modified polyester (a) were mixed by dissolving them in 2000 parts of a mixed solvent of ethyl acetate/MEK (1/1) to give a solution of toner binder (2) in ethyl acetate/MEK. This was partly dried under reduced pressure to isolate the toner binder (2). Its Tg was 65° C., and its acid value was 10.

Production of Toner

A toner (2) of the present invention was formulated in the same manner as in Example 1 except that the dissolving and dispersing temperature was changed to 50° C. herein. Its test data are given in Table 2.

At least 3 wax particles were in each toner particle, in which wax particles having a dispersed particle diameter of 0.1 to 2 μm accounted for 90% of all the wax particles therein. No wax particles of 3 μm or larger were found in the toner particles. The orientation of the wax particles dispersed in the toner particles was as in FIG. 5.

Example 3

Preparation of Toner Binder 30 parts of the urea-modified polyester (1) and 970 parts of the non-modified polyester (a) were mixed by dissolving them in 2000 parts of a solvent ethyl acetate to give a solution of toner binder (3) in ethyl acetate. This was partly dried under reduced pressure to isolate the toner binder (3).

Production of Toner

A toner (3) having a weight-average particle diameter of 6 μm was formulated in the same manner as in Example 1 except that the toner binder (3) but not the toner binder (1) was used herein. The number of wax particles having a dispersed particle diameter of 0.1 to 2 μm in each toner particle was counted on 3 TEM pictures selected at random, resulting in 85% by number on average. No wax particles of 3 μm or larger were found in the toner particles. The other test data of the toner (3) are given in Table 2.

Example 4

Preparation of Toner Binder 450 parts of the urea-modified polyester (1) and 450 parts of the non-modified polyester (a) were mixed by dissolving them in 1900 parts of ethyl acetate to give a solution of toner binder (4) in ethyl acetate. This was partly dried under reduced pressure to isolate the toner binder (4).

Production of Toner

A toner (4) having a weight-average particle diameter of 6.2 μm was formulated in the same manner as in Example 1 except that the toner binder (4) but not the toner binder (1) was used herein. The proportion of wax particles having a major diameter of 3 μm or more in the toner particles was confirmed on the TEM pictures showing the particle cross sections, and it was 2%. On the TEM pictures, it was confirmed that all the wax particles were oriented toward the inside of each toner particle. The test data of the toner (4) are given in Table 2.

Example 5

Preparation of Toner Binder 815 parts of bisphenol A-ethylene oxide (2 mols) adduct and 215 parts of terephthalic acid were polycondensed for 6 hours at 200° C. under atmospheric pressure, and then further reacted for 5 hours under a reduced pressure of 30 to 50 mmHg to give a non-modified polyester (b) having a peak molecular weight of 4000. 100 parts of the urea-modified polyester (1) and 900 parts of the non-modified polyester (b) were mixed by dissolving them in 2000 parts of ethyl acetate to give a solution of toner binder (5) in ethyl acetate. This was partly dried under reduced pressure to isolate the toner binder (5). Its acid value was 0.5.

Production of Toner

A toner (5) having a weight-average particle diameter of 8.2 μm was formulated in the same manner as in Example 1 except that the toner binder (5) but not the toner binder (1) was used herein. Its test data are given in Table 2.

At least 3 wax particles were present in each toner particle, in which wax particles having a dispersed particle diameter of 0.1 to 2 μm accounted for 90% of all the wax particles therein. The orientation of the wax particles dispersed in the toner particles was as in FIG. 5.

Example 6

Preparation of Toner Binder 824 parts of bisphenol A-ethylene oxide (2 mols) adduct and 276 parts of terephthalic acid were polycondensed for 10 hours at 210° C. under atmospheric pressure, and then further reacted for 5 hours under a reduced pressure of 5 to 20 mmHg to give a non-modified polyester (c) having a peak molecular weight of 5000. 100 parts of the urea-modified polyester (1) and 900 parts of the non-modified polyester (c) were mixed by dissolving them in 2000 parts of ethyl acetate to give a solution of toner binder (6) in ethyl acetate. This was partly dried under reduced pressure to isolate the toner binder (6).

Production of Toner

A toner (6) having a weight-average particle diameter of 5 μm was formulated in the same manner as in Example 1 except that the toner binder (6) but not the toner binder (1) was used herein. Its test data are given in Table 2.

At least 3 wax particles were present in each toner particle, in which wax particles having a dispersed particle diameter of 0.1 to 2 μm accounted for 90% of all the wax particles therein. The orientation of the wax particles dispersed in the toner particles was as in FIG. 5.

Example 7

Preparation of Toner Binder 724 parts of bisphenol A-ethylene oxide (2 mols) adduct and 276 parts of terephthalic acid were polycondensed for 8 hours at 230° C. under atmospheric pressure, and then further reacted for 5 hours under a reduced pressure of 10 to 15 mmHg. After this was cooled to 160° C., 32 parts of trimellitic anhydride was added thereto and reacted for 2 hours to give a non-modified polyester (d) having a peak molecular weight of 5000. 100 parts of the urea-modified polyester (1) and 900 parts of the non-modified polyester (d) were mixed by dissolving them in 2000 parts of a mixed solvent of ethyl acetate/MEK (1/1) to give a solution of toner binder (7) in ethyl acetate/MEK. This was partly dried under reduced pressure to isolate the toner binder (7). Its acid value was 25.

Production of Toner

A toner (7) having a weight-average particle diameter of 7.2 μm was formulated in the same manner as in Example 1 except that the toner binder (7) but not the toner binder (1) was used herein. Its test data are given in Table 2.

Example 8

Preparation of Toner Binder 608 parts of bisphenol A-ethylene oxide (2 mols) adduct and 215 parts of terephthalic acid were polycondensed for 6 hours at 200° C. under atmospheric pressure, and then further reacted for 5 hours under a reduced pressure of 10 to 15 mmHg. After this was cooled to 160° C., 48 parts of trimellitic anhydride was added thereto and reacted for 2 hours to give a non-modified polyester (e) having a peak molecular weight of 15,000. 100 parts of the urea-modified polyester (1) and 900 parts of the non-modified polyester (e) were mixed by dissolving them in 2000 parts of ethyl acetate to give a solution of toner binder (8) in ethyl acetate. This was partly dried under reduced pressure to isolate the toner binder (8). Its acid value was 35.

Production of Toner

A toner (8) having a weight-average particle diameter of 7.2 μm was formulated in the same manner as in Example 1 except that the toner binder (8) but not the toner binder (1) was used herein. Its test data are given in Table 2.

Example 9

Preparation of Toner Binder 624 parts of bisphenol A-ethylene oxide (2 mols) adduct and 215 parts of terephthalic acid were polycondensed for 2 hours at 200° C. under atmospheric pressure, and then further reacted for 5 hours under a reduced pressure of 10 to 15 mmHg to give a non-modified polyester (f) having a peak molecular weight of 1000. 100 parts of the urea-modified polyester (1) and 900 parts of the non-modified polyester (f) were mixed by dissolving them in 2000 parts of ethyl acetate to give a solution of toner binder (9) in ethyl acetate. This was partly dried under reduced pressure to isolate the toner binder (9).

Production of Toner

A toner (9) having a weight-average particle diameter of 8.1 μm was formulated in the same manner as in Example 1 except that the toner binder (9) but not the toner binder (1) was used herein. Its test data are given in Table 2.

Example 10

Preparation of Toner Binder 624 parts of bisphenol A-ethylene oxide (2 mols) adduct and 215 parts of terephthalic acid were polycondensed for 12 hours at 200° C. under atmospheric pressure, and then further reacted for 5 hours under a reduced pressure of 10 to 15 mmHg to give a non-modified polyester (i) having a peak molecular weight of 30,000. 100 parts of the urea-modified polyester (1) and 900 parts of the non-modified polyester (i) were mixed by dissolving them in 2000 parts of ethyl acetate to give a solution of toner binder (10) in ethyl acetate. This was partly dried under reduced pressure to isolate the toner binder (10).

Production of Toner

A toner (10) having a weight-average particle diameter of 5.2 μm was formulated in the same manner as in Example 1 except that the toner binder (10) but not the toner binder (1) was used herein. Its test data are given in Table 2.

Example 11

Production of Toner:

A toner (11) having a weight-average particle diameter of 6.8 μm was formulated in the same manner as in Example 1, to which, however, pentaerythritol tetrabehenate was not added. Its test data are given in Table 2.

Example 12

Preparation of Prepolymer 800 parts of bisphenol A-ethylene oxide (2 mols) adduct, 200 parts of isophthalic acid, 15 parts of terephthalic acid, and 2 parts of dibutyltin oxide were put into a reactor equipped with a condenser tube, stirrer and a nitrogen-introducing duct, and reacted therein at 200° C. under atmospheric pressure for 6 hours, and then for 5 hours under a reduced pressure of 10 to 15 mmHg with removing water. After this was cooled to 160° C., 30 parts of phthalic anhydride was added thereto and reacted for 2 hours. Next, this was cooled to 8° C., and reacted with 170 parts of isophorone diisocyanate in ethyl acetate for 2 hours to give an isocyanate-having prepolymer (2) having a weight-average molecular weight of 12,000.

Preparation of Ketimine Compound 30 parts of isophoronediamine and 70 parts of methyl ethyl ketone were put into a reactor equipped with a stirring rod and a thermometer, and reacted therein at 50° C. for 5 hours to give a ketimine compound (1).

Production of Toner 15.4 parts of the prepolymer (2), 60 parts of the polyester (a) and 78.6 parts of ethyl acetate were put into a beaker, and dissolved by stirring them. Next, 20 parts of carnauba wax, 5 parts of styrene acryl dispersant (styrene/nBA), and 4 parts of copper phthalocyanine blue pigment were added thereto and uniformly dissolved and dispersed by stirring them at 60° C. with a TK-type homomixer at 12,000 rpm. Finally, 2.7 parts of the ketimine compound (1) was added thereto and dissolved. This is a toner material solution (2). On the other hand, 706 parts of ion-exchanged water, 260 parts of 10% hydroxyapatite suspension (Nippon Chemical Industry's Supertite 10), and 0.2 parts of sodium dodecylbenzenesulfonate were put into a beaker and uniformly dissolved. Next, this was heated up to 60° C., and with stirring it with a TK-type homomixer at 12,000 rpm, the toner material solution (2) was added thereto, and stirred for 10 minutes. The resulting mixture was transferred into a flask equipped with a stirring rod and a thermometer, and heated up to 98° C. for urea formation for 2 hours with removing the solvent. This was filtered, washed and dried, and then pneumatically classified to obtain toner particles having an uneven surface morphology and having a weight-average particle diameter of 7 μm. Next, 100 parts of the toner particles were mixed with 0.5 parts of hydrophobic silica and 0.5 parts of hydrophobic titanium oxide using a Henschel mixer to obtain a toner (12) having a particle diameter of 7.5 μm of the present invention. Its test data are given in Table 2.

Example 13

A toner (13) of the present invention was produced in the same manner as in Example 12, for which, however, used was an ester wax (molecular weight 1500, m.p. 85° C., needle penetration 2 mm/50° C., acid value 1.5) in place of the wax used in Example 12. Its test data are given in Table 2.

Example 14

Preparation of Prepolymer 955 parts of bisphenol A-ethylene oxide (2 mols) adduct, 240 parts of isophthalic acid, 15 parts of terephthalic acid, and 2 parts of dibutyltin oxide were put into a reactor equipped with a condenser tube, stirrer and a nitrogen-introducing duct, and reacted therein at 200° C. under atmospheric pressure for 6 hours, and then for 5 hours under a reduced pressure of 50 to 100 mmHg with removing water. After this was cooled to 160° C., 32 parts of phthalic anhydride was added thereto and reacted for 2 hours. Next, this was cooled to 80° C., and reacted with 170 parts of isophorone diisocyanate in ethyl acetate for 2 hours to give an isocyanate-having prepolymer (3) having a weight-average molecular weight of 12,000.

Preparation of Ketimine Compound 30 parts of isophoronediamine and 70 parts of methyl ethyl ketone were put into a reactor equipped with a stirring rod and a thermometer, and reacted therein at 50° C. for 5 hours to give a ketimine compound (1).

Production of Toner 15.4 parts of the prepolymer (3), 50 parts of the polyester (a) and 95.2 parts of ethyl acetate were put into a beaker, and dissolved by stirring them. Next, 20 parts of carnauba wax (molecular weight 1800, add value 2.5, needle penetration 1.5 mm/50° C.) and 3 parts of copper phthalocyanine blue pigment were added thereto and uniformly dissolved and dispersed by stirring them at 85° C. with a TK-type homomixer at 12,000 rpm. Finally, 2.7 parts of the ketimine compound (1) was added thereto and dissolved. This is a toner material solution (1). On the other hand, 865 parts of ion-exchanged water, 245 parts of 10% hydroxyapatite suspension (Nippon Chemical Industry's Supertite 10), and 0.4 parts of sodium dodecylbenzenesulfonate were put into a beaker and uniformly dissolved. Next, this was heated up to 60° C., and with stirring it with a TK-type homomixer at 12,000 rpm, the toner material solution (1) was added thereto, and stirred for 10 minutes. The resulting mixture was transferred into a flask equipped with a stirring rod and a thermometer, and heated up to 60° C. for urea formation for 2 hours with removing the solvent. This was filtered, washed and dried, and then pneumatically classified to obtain toner particles having a weight-average particle diameter of 7 μm. Next, 100 parts of the toner particles were mixed with 0.3 parts of hydrophobic silica and 0.3 parts of hydrophobic titanium oxide using a Henschel mixer to obtain a toner (14) of the present invention. Its test data are given in Table 2.

Comparative Example 1

Preparation of Toner Binder 395 parts of bisphenol A-ethylene oxide (2 mols) adduct and 166 parts of isophthalic acid were polycondensed in the presence of 2 parts of a catalyst dibutyltin oxide to give a comparative toner binder (x) having a weight-average molecular weight of 8000. Tg of the comparative toner binder (x) was 57° C.

Production of Toner 100 parts of the comparative toner binder (x), 180 parts of ethyl acetate, 4 parts of copper phthalocyanine blue pigment, and 5 parts of rice wax (m.p. 82° C., needle penetration 9 at 50° C.) were put into a beaker and uniformly dissolved and dispersed by stirring them at 50° C. with a TK-type homomixer at 10,000 rpm. Next, this was processed in the same manner as in Example 1 to produce toner, for which, however, the toner material mixture was stirred more strongly to remove the solvent and the solvent removal took 8 hours. The comparative toner (1) thus produced had a true-spherical particle morphology having a weight-average particle diameter of 6 μm. The main peak molecular weight Mp of the binder resin in the toner was 5000; the content of molecules having Mw of 30,000 or more in the binder resin was 0.3%; and Mw/Mn of the binder resin was 2. The test data of the comparative toner (1) are given in Table 2.

Comparative Example 2

Preparation of Toner Binder 343 parts of bisphenol A-ethylene oxide (2 mols) adduct, 166 parts of isophthalic acid and 2 parts of dibutyltin oxide were put into a reactor equipped with a condenser tube, a stirrer and a nitrogen-introducing duct, and reacted therein for 8 hours at 230° C. under atmospheric pressure, and then for 5 hours under a reduced pressure of 10 to 15 mmHg. After this was cooled to 80° C., 14 parts of toluene diisocyanate was added thereto in toluene, and reacted with it at 110° C. for 5 hours. The solvent was removed to give an urethane-modified polyester (1) having a weight-average molecular weight of 98,000. On the other hand, 363 parts of bisphenol A-ethylene oxide (2 mols) adduct and 166 parts of isophthalic acid were polycondensed in the same manner as in Example 1 to give a non-modified polyester (j) having a peak molecular weight of 3800, a hydroxyl value of 25 and an acid value of 7. 350 parts of the urethane-modified polyester and 650 parts of the non-modified polyester were dissolved in toluene by mixing them, and the solvent was removed to give a comparative toner binder (y). Tg of the comparative toner binder (y) was 58° C.

Production of Toner 100 parts of the comparative toner binder (y), 4 parts of copper phthalocyanine blue pigment, and 10 parts of candelilla wax (m.p. 69° C., needle penetration 5.8, Mw 900, acid value 16) were processed to form a toner according to the method mentioned below. Concretely, these were premixed in a Henschel mixer, and then kneaded in a continuous kneader. Next, this was ground in a jet mill, and then classified in a pneumatic classifier to obtain toner particles having a weight-average particle diameter of 6 μm. Next, 100 parts of the toner particles were mixed with 0.5 parts of hydrophobic silica and 0.5 parts of hydrophobic titanium oxide in a Henschel mixer to give a comparative toner (2). The main peak molecular weight Mp of the binder resin in the toner was 3800; the content of molecules having Mw of 30,000 or more in the binder resin was 15%; and Mw/Mn of the binder resin was 6. The test data of the comparative toner (2) are given in Table 2.

Test Methods:

Toner Flowability:

Using a powder tester from Hosokawa Micron, the bulk density of toner was measured. Toner of better flowability has higher bulk density. Thus tested, toner was ranked as follows:

D: lower than 0.25.

C: 0.25 to 0.30.

B: 0.30 to 0.35.

A: higher than 0.35.

Thermal Storability:

After kept at 50° C. for 8 hours, the toner was sieved through a 42-mesh sieve for 2 minutes, and the residue on the sieve was measured. This indicates the thermal storability of toner. Toner of better thermal storability gives a smaller amount of residue on the sieve in the test. Thus tested, toner was ranked as follows:

D: more than 30%.

C: 20 to 3%.

B: 10 to 20%.

A: less than 10%.

Lowermost Temperature for Toner Fixing:

A Ricoh's copier MF-2000 having a fixing roller of Teflon is modified in the fixing zone, and Ricoh's copy paper of type 6200 is set in the modified copier, in which toner is tested for image forming on the copy paper. The image fixed on the copy paper was rubbed with a pad, and the image retention thereon was measured. The temperature of the fixing roller at which the image fixed on the copy paper had an image retention of 70% or more indicates the lowermost temperature for toner fixing.

Hot Offsetting Temperature (HOT):

The image fixed on the copy paper in the same manner as in the test for toner fixing as above was visually checked for hot offsetting. The temperature of the fixing roller at which the paper with an image fixed thereon had suffered hotoffsetting indicates the hot-offsetting temperature of toner.

Gloss-expressing Temperature (GLOSS):

The toner is tested in the fixing unit of a commercial color copier, Ricoh's PRETER 550. The temperature of the fixing roller at which the 60-degree gloss of the fixed image was 10% or more indicates the gloss-expressing temperature of toner.

Test Results:

The toners of the present invention produced in Examples 1 to 14 and the comparative toners 1 and 2 were tested in a laboratory copier having a belt fixing unit of FIG. 1 and FIG. 2.

Figure 3:
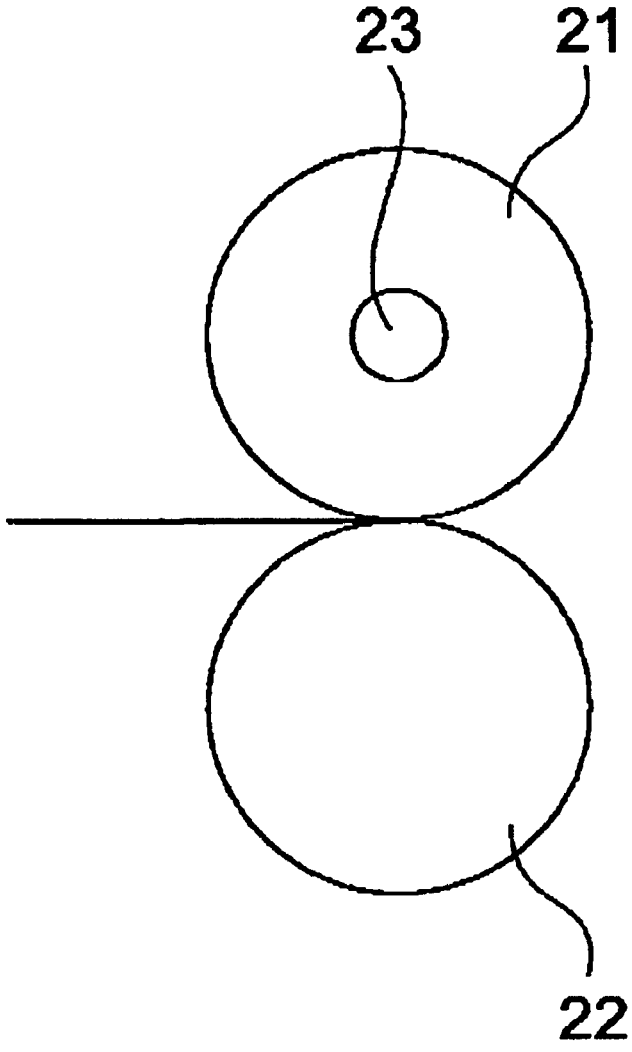
FIG. 3 is a conceptual view showing a hot roller fixing unit.

In addition, the comparative toners 1 and 2 were tested in a different laboratory copier having a roller fixing unit of FIG. 3.

The test condition in the belt fixing unit is as follows:

As in FIGS. 1 and 2 showing the conceptual views thereof, the belt fixing unit used herein comprises a fixing roller 2, a heating roller 1, an endless fixing belt 3 laid along the heating roller 1 and the fixing roller 2 under tension therebetween, a pressure roller 4 disposed adjacent to the fixing roller 2 via the fixing belt 3, and a fixing heater 5 disposed inside the heating roller 1. A toner image on transfer paper, a type of transfer material that is conveyed between the pressure roller 4 and the fixing belt 3 is fixed thereon in this unit The unit is so controlled that, in the step for fixing in the part 8 in which the pressure roller 4 is kept in contact with the fixing belt 3 not pressing the fixing roller 2 via the fixing belt 3, the fixing pressure to the transfer paper is settled low so as not to wrinkle the transfer paper, and in the second step for fixing in the part 9 in which the pressure roller 4 presses the fixing roller 2 via the fixing belt 3, the fixing pressure to the transfer paper is settled to ensure the intended toner fixing on the transfer paper.

In the step for fixing, the toner on the transfer paper is pre-fixed thereon through thermal conduction and the fixing pressure is kept low so as not to wrinkle the transfer paper. For this, it is desirable that the fixing belt 3 is lightly contacted with the pressure roller 4.

The fixing pressure is described in relation to the wrinkle resistance of transfer paper, a type of transfer material for toner fixing thereon. For a fixing pressure of 1 kg/cm$^2$ in the belt fixing unit as herein, for example, the tension of the fixing belt 3 is 9 kg, the width of the fixing belt 3 is 310 mm and the contact length of the fixing belt 3 is 3 mm. In this case, 9 kg/ (31 cm×0.3 cm)≈1 kg/cm$^2$. For a fixing pressure of 0.5 kg/cm$^2$, for example, 4.5 kg/(31 cm×0.3 cm)≈0.5 kg/cm$^2$. Transfer paper having run through the belt fixing unit is checked for wrinkles, and ranked as follows: Rank 3 and higher will not receive users' complaints. Precisely, rank 5 means no wrinkles formed; rank 4 means a few and negligible wrinkles formed; rank 3 means some but negligible wrinkles formed, which will not receive users' complaints; rank 2 means some but nonnegligible wrinkles formed, which will receive users' complaints; and rank 1 means many and remarkable wrinkles formed.

In this test, all the toners of examples 1 to 14 were tested under a fixing pressure of 1 kg/cm$^2$, under which all sheets of transfer paper tested for these toners were on the level of rank 4 or higher.

TABLE 1

| | Binder used | Composition (Modified Polyester or Preparation of Polyester/Non-modified polyester) | Mp | Component having Mw of 30,000 or more (%) | Mn | Mw/Mn | Component having Mw of 1000 or less (%) | THF Insolubles (%) | Acid Value | Tg (° C.) |
|---|---|---|---|---|---|---|---|---|---|---|
| Ex. 1 | Non-modified Polyester (a) + Urea Modified Polyester (1) | 10/90 | 4000 | 4 | 2500 | 3.5 | 4 | 5 | 7 | 60 |
| Ex. 2 | Non-modified Polyester (a) + Urea Modified Polyester (2) | 20/80 | 4000 | 5 | 4000 | 3.8 | 4 | 3 | 7 | 64 |
| Ex. 3 | Non-modified Polyester (a) + Urea Modified Polyester (3) | 3/97 | 4000 | 2 | 2500 | 4.1 | 3 | 3 | 7 | 62 |
| Ex. 4 | Non-modified Polyester (a) + Urea Modified Polyester (4) | 50/50 | 4000 | 6 | 4000 | 3.6 | 4 | 6 | 7 | 61 |
| Ex. 5 | Non-modified Polyester (b) + Urea Modified Polyester (1) | 10/90 | 4000 | 7 | 4500 | 4.1 | 2 | 4 | 0.5 | 61 |
| Ex. 6 | Non-modified Polyester (c) + Urea Modified Polyester (1) | 10/90 | 4000 | 7 | 2300 | 3.5 | 2 | 1 | 2 | 61 |

TABLE 1-continued

| | Binder used | Composition (Modified Polyester or Preparation of Polyester/Non-modified polyester) | Mp | Component having Mw of 30,000 or more (%) | Mn | Mw/Mn | Component having Mw of 1000 or less (%) | THF Insolubles (%) | Acid Value | Tg (° C.) |
|---|---|---|---|---|---|---|---|---|---|---|
| Ex. 7 | Non-modified Polyester (d) + Urea Modified Polyester (1) | 10/90 | 4000 | 7 | 4100 | 3.4 | 3 | 4 | 8 | 69 |
| Ex. 8 | Non-modified Polyester (e) + Urea Modified Polyester (1) | 10/90 | 15000 | 6 | 15000 | 4.6 | 1 | 8 | 25 | 62 |
| Ex. 9 | Non-modified Polyester (f) + Urea Modified Polyester (1) | 10/90 | 1000 | 4 | 2300 | 2.9 | 4 | 2 | 8 | 45 |
| Ex. 10 | Non-modified Polyester (i) + Urea Modified Polyester (1) | 10/90 | 20000 | 7 | 12000 | 4.2 | 1 | 7 | 8 | 73 |
| Ex. 11 | Non-modified Polyester (a) + Urea Modified Polyester (1) | 10/90 | 4000 | 5 | 4200 | 4.3 | 3 | 3 | 8 | 62 |
| Ex. 12 | Non-modified Polyester (a) + Preparation of Polyester (2) | 15.4/60 | 4000 | 5 | 3500 | 3.5 | 2 | 2 | 8 | 62 |
| Ex. 13 | Non-modified Polyester (a) + Preparation of Polyester (2) | 15.4/60 | 4000 | 5 | 3100 | 3.8 | 5 | 2 | 8 | 62 |
| Ex. 14 | Non-modified Polyester (a) + Preparation of Polyester (3) | 15.4/50 | 4000 | 6 | 5200 | 2.8 | 4 | 3 | 8 | 62 |
| Comp. Ex. 1 | Non-modified Polyester (x) | — | 5000 | 0.3 | 4200 | 3.5 | 3 | 0 | 5 | 57 |
| Comp. Ex. 2 | Non-modified Polyester (j) + Urethane Modified Polyester | 35/65 | 3800 | 12 | 2500 | 4.2 | 5 | 0 | 0.5 | 60 |

TABLE 2

| | | | Belt Fixing Unit | | | | | | | Roller Fixing Unit | | | |
|---|---|---|---|---|---|---|---|---|---|---|---|---|---|
| Item Unit | Weight-average particle diameter μm | Roundness | Lowermost Temperature for toner fixing ° C. | GLOSS ° C. | HOT ° C. | Charge Stability | Haze | Thermal Storability | Toner Flow | Lowermost Temperature for toner fixing ° C. | GLOSS ° C. | HOT ° C. | Haze |
| Ex. 1 | 6.0 | 0.96 | 140 | 150 | 220 | B | B | B | B | — | — | — | — |
| Ex. 2 | 6.9 | 0.98 | 140 | 150 | 225 | B | B | B | B | — | — | — | — |
| Ex. 3 | 6.0 | 0.98 | 135 | 145 | 200 | B | B | C | B | — | — | — | — |
| Ex. 4 | 6.2 | 0.97 | 145 | 160 | 210 | B | A | B | B | — | — | — | — |
| Ex. 5 | 8.2 | 0.97 | 145 | 150 | 220 | B | B | B | B | — | — | — | — |
| Ex. 6 | 6.9 | 0.97 | 140 | 150 | 220 | B | B | B | B | — | — | — | — |
| Ex. 7 | 7.2 | 0.96 | 140 | 150 | 220 | B | B | B | B | — | — | — | — |
| Ex. 8 | 7.5 | 0.98 | 135 | 150 | 220 | B | B | B | B | — | — | — | — |
| Ex. 9 | 8.1 | 0.96 | 130 | 140 | 200 | B | A | B | B | — | — | — | — |
| Ex. 10 | 5.2 | 0.98 | 160 | 170 | 230 | B | C | B | A | — | — | — | — |
| Ex. 11 | 6.8 | 0.98 | 140 | 160 | 200 | B | A | B | B | — | — | — | — |
| Ex. 12 | 7.5 | 0.97 | 150 | 150 | 230 | B | B | B | B | — | — | — | — |
| Ex. 13 | 5.9 | 0.96 | 140 | 150 | 220 | B | B | B | B | — | — | — | — |
| Ex. 14 | 4.8 | 0.97 | 140 | 150 | 220 | B | B | B | B | — | — | — | — |
| Co. Ex. 1 | 6.8 | 0.98 | 140 | 145 | 170 | C | D | C | D | 140 | 145 | 185 | C |
| Co. Ex. 2 | 7.2 | 0.93 | 140 | 150 | 200 | C | D | B | B | 140 | 150 | 210 | B |
| | | | | | | | | | | | Roller Fixing | | |

What is claimed is:

1. A method of fixing toner in a belt fixing unit having a fixing roller; a heating roller; an endless fixing belt binding the heating roller and the fixing roller under tension therebetween; a pressure roller disposed to face the fixing roller intervening the fixing belt; and a fixing heater disposed inside one of the pressure roller and the heating roller, comprising:

a step for fixing a toner image on an image fixing material by conveying the toner image on the image fixing material in between a portion of the fixing belt not touching the fixing roller and the pressure roller; and a second step for fixing the toner image on the image fixing material by moving the portion of the fixing belt not touching the fixing roller to touch the fixing roller and conveying the toner image on the image fixing material in between the portion of the fixing belt and the pressure roller, wherein the toner particle is spherical having a roundness of 0.96 or more and contains a colorant and resin component containing a modified polyester resin.

2. The method for fixing toner according to claim 1, wherein a fixing pressure exerted in between the fixing belt and the pressure roller in the step for fixing is reduced to avoid causing wrinkles on the image fixing material.

3. A The method for fixing toner according to claim 2, wherein the fixing pressure in the step for fixing is 1 $kg/cm^2$ or less and a fixing pressure in the second step for fixing is not lower than the fixing pressure in the step for fixing.

4. The method for fixing toner according to claim 1, wherein the heating roller is a heating roller of low heat capacity.

5. The method for fixing toner according to claim 1, wherein the toner comprises a releasing agent.

6. The method for fixing toner according to claim 5, wherein the releasing agent is a wax having a melting point of 60 to 120° C. and the toner comprises 1 to 20% by weight of the wax.

7. The method for fixing toner according to claim 6, wherein the wax has a weight-average molecular weight of 400 to 5000 and an acid value of 1 to 30 mg KOH/g.

8. The method for fixing toner according to claim 5, wherein the releasing agent particles are uniformly dispersed inside the toner particles, and the toner particles each carrying at least 3 releasing agent particles therein account for 70% or more by number of all the toner particles.

9. The method for fixing toner according to claim 5, wherein the releasing agent particles each having a dispersed particle diameter of 0.1 μm to 2 μm account for 70% or more by number of all the releasing agent particles.

10. The method for fixing toner according to claim 5, wherein the releasing agent particles are needle-wise dispersed inside the toner particles, and the releasing agent particles having a maximum diameter of 3 μm or more do not exceed 5% by number of all the releasing agent particles.

11. The method for fixing toner according to claim 10, wherein the releasing agent particles are dispersed inside the toner particles in a manner to orient in a direction of the maximum diameter of each releasing agent particle is not in parallel to the surface of the toner particle but is oriented toward the inside of the toner particle or is not exposed at the surface of the toner particle.

12. The method for fixing toner according to claim 5, wherein the releasing agent is vegetable wax having a molecular weight of 400 to 2500 and an acid value of 1 to 30 mg KOH/g.

13. The method for fixing toner according to claim 5, wherein the releasing agent is ester wax and the needle penetration at 50° C. into the toner particles with the releasing agent dispersed is 3 or less.

14. The method for fixing toner according to claim 1, wherein the toner is prepared by dissolving or dispersing a toner composition that contains at least a modified polyester resin and a colorant, in an organic solvent, followed by granulating the composition in an aqueous medium.

15. The method for fixing toner according to claim 14, wherein the toner composition further comprises a releasing agent.

16. The method for fixing toner according to claim 1, wherein the toner is prepared by dissolving or dispersing in an organic solvent, a toner composition that comprises at least a polyester prepolymer and a colorant, granulating the toner composition in an aqueous medium while forming an urea bond-having polyester in the resulting toner particles under polyaddition reaction.

17. The method for fixing toner according to claim 16, wherein the toner composition further comprises a releasing agent.

18. The method for fixing toner according to claim 1, wherein the toner further comprises a non-modified polyester resin and the ratio by weight of the modified polyester resin to the non-modified polyester resin in the toner is of from 5/95 to 80/20.

19. The method for fixing toner according to claim 1, wherein the resin component comprises, 5% or less Tetrahydrofuran soluble composition having 1000 or less molecular weight.

20. The method for fixing toner according to claim 1, wherein the resin component has a glass transition point of 55 to 70° C.

21. The method for fixing toner according to claim 1, wherein the tetrahydrofuran insolubles in the resin component account for 1 to 15% of the resin component.

22. The method for fixing toner according to claim 1, wherein the resin component is controlled to have a molecular weight peak of tetrahydrofuran solubles appearing in the range of from 1000 to 30,000 and the tetrahydrofuran-soluble component having a molecular weight of 30,000 or more account for 1% or more, and the toner has a weight-average particle diameter of from 3 to 10 μm.

23. The method for fixing toner according to claim 1, wherein the molecular weight distribution of tetrahydrofuran solubles in the resin component is designed to have the number-average molecular weight ranging from 2000 to 15,000 and the ratio of weight-average molecular weight/number-average molecular weight thereof is 10.0 or less.

* * * * *